United States Patent [19]

Kitamori et al.

[11] Patent Number: 5,041,351

[45] Date of Patent: Aug. 20, 1991

[54] ONE COMPONENT DEVELOPER FOR DEVELOPING ELECTROSTATIC IMAGE AND IMAGE FORMING METHOD

[75] Inventors: Naoto Kitamori; Hisayuki Ochi, both of Yokohama; Tetsuya Kuribayashi, Tokyo; Manabu Ohno; Tetsuhito Kuwashima, both of Yokohama; Hitoshi Uchide, Toride, all of Japan

[73] Assignee: Canon Kabushiki Kaisha, Tokyo, Japan

[21] Appl. No.: 329,815

[22] Filed: Mar. 28, 1989

[30] Foreign Application Priority Data

Mar. 30, 1988 [JP] Japan ..... 63-79825
Apr. 1, 1988 [JP] Japan ..... 63-81940

[51] Int. Cl.[5] ..... G03G 9/083

[52] U.S. Cl. ..... 430/106.6; 430/110; 430/111; 430/903

[58] Field of Search ..... 430/106.6, 110, 111, 430/903

[56] References Cited

U.S. PATENT DOCUMENTS

| | | | |
|---|---|---|---|
| 3,900,588 | 8/1975 | Fisher | 427/19 |
| 4,269,920 | 5/1981 | Wada et al. | 430/107 |
| 4,514,485 | 4/1985 | Ushiyama et al. | 430/106.6 |
| 4,626,487 | 12/1986 | Mitsuhashi et al. | 430/106.6 X |
| 4,737,432 | 4/1988 | Tanaka et al. | 430/110 |
| 4,804,609 | 2/1989 | Imanaka et al. | 430/106.6 |
| 4,868,084 | 9/1989 | Uchide et al. | 430/110 |
| 4,904,558 | 2/1990 | Nagatsuka et al. | 430/110 X |
| 4,935,325 | 6/1990 | Kuribayashi et al. | 430/106.6 |
| 4,980,256 | 12/1990 | Kato et al. | 430/106.6 |

FOREIGN PATENT DOCUMENTS

| | | | |
|---|---|---|---|
| 0052502A1 | 5/1982 | European Pat. Off. . | |
| 0186377 | 7/1986 | European Pat. Off. | 430/106.6 |
| 53-133446 | 11/1978 | Japan | 430/106.6 |
| 1-126660 | 5/1989 | Japan | 430/106.6 |
| 2145942 | 4/1985 | United Kingdom . | |

*Primary Examiner*—Roland Martin
*Attorney, Agent, or Firm*—Fitzpatrick, Cella, Harper & Scinto

[57] ABSTRACT

A developer for developing electrostatic images, comprising: at least, 100 wt. parts of a negatively chargeable magnetic toner having a volume-average particle size of 5 to 30 microns; 0.1 to 3 wt. parts of potitively chargeable resin particles having an average particle size of 0.1 to 1.0 micron; and 0.05 to 3 wt. parts of hydrophobic silica fine powder having a triboelectric chargeability of −100 to −300 μc/g.

36 Claims, 4 Drawing Sheets

ONE COMPONENT DEVELOPER FOR DEVELOPING ELECTROSTATIC IMAGE AND IMAGE FORMING METHOD

FIELD OF THE INVENTION AND RELATED ART

The present invention relates to a dry developer and an image forming method for developing electrostatic images in an image forming method such as electrophotography, electrostatic recording and electrostatic printing, more particularly to a negatively chargeable magnetic developer which is uniformly and strongly charged negatively to visualize a positively charged electrostatic image through normal development or to visualize a negatively charged electrostatic image through reversal development in a direct or indirect electrophotographic developing process thereby providing high-quality images, and an image forming method using the developer.

Further, the present invention relates to an image forming method which uses a developer comprising a negatively chargeable toner and positively chargeable resin particles and includes a step of well transferring a toner image formed on an electrostatic image-bearing member to a transfer material.

Hitherto, electrophotographic processes have been known, as disclosed in U.S. Pat. No. 2,297,691 Japanese Patent publication (KOKOKU) No. 23910/1967 (U.S. Pat. No. 3,666,363), Japanese Patent Publication No. 24748/1968 (U.S. Pat. No. 4,071,361, and others. Generally speaking, photoconductive materials are utilized in these processes, and the steps included therein comprise forming electrical latent images on photosensitive members by various means, then developing the latent images by using a toner or developer, transferring the toner images thus formed to a transfer material (or recording medium) such as paper, as desired, and thereafter fixing the images by heating, pressure, heating and pressure roller, or solvent vapor to obtain copies. When the step of transferring the toner images is adopted, it is a general practice to provide a step for removing residual toner on the photosensitive member.

The developing methods for visualizing electrical latent images by use of toners known in the art may include, for example, the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776; and the method using conductive magnetic toner as disclosed in U.S. Pat. No. 3,909,258.

As the toner to be applied for these developing methods, fine powder of natural or synthetic resins having dyes or pigments dispersed therein have heretofore generally been used. For example, a colorant is dispersed in a binder resin such as polystyrene, and the particles obtained by micro-pulverizing the resultant dispersion into sizes of about 1 to 30 microns are used as the toner. As a one-component developer, there has been used a magnetic toner wherein magnetic particles are further incorporated into the particles as mentioned above. In case of the system employing a two-component developer, the toner as mentioned above is used generally in mixture with carrier particles such as glass beads, iron particles, ferrite particles or particles obtained by coating these particles with a resin.

In the production process for the toner to be used in a developer, the content of fine powder (particle size; 4 microns or below) is controlled by a method such as classification and heat treatment, but the developer tends to deteriorate due to the accumulation of fine powder.

When the developer contains the above-mentioned fine powder, the fine powder selectively accumulates in the neighborhood of the surface of a developer-carrying member such as a sleeve due to the difference in developing characteristic between it and other suitable developer particles, and the suitable developer particles form a layer on such a fine powder layer. As a result, it becomes difficult to obtain a charge amount suitable for development, and there sometimes occurs a difference in image density between an image portion corresponding to a portion of the developer-carrying member surface provided with the fine powder layer and that corresponding to a normal portion thereof i.e., a portion provided with substantially no fine powder layer, (hereinafter, such a phenomenon in a developer-carrying member is referred to as "memory phenomenon").

Particularly, in the case of the one-component magnetic developer, the magnetic material content in each fine toner particle tends to be lower than that in a toner particle having a suitable particle size, and the amount of charge imparted to the fine toner particle becomes larger than that imparted to the suitable toner particle. Accordingly, the fine toner particles are strongly attached to the developer-carrying member due to mirror image force and the above-mentioned memory phenomenon in the developer-carrying member (i.e., sleeve ghost) becomes marked.

When such memory phenomenon occurs, an image shown by an image portion 4 in FIG. 1C described hereinafter is formed.

More specifically, when an image 1 having a width a as shown in FIG. 1A is developed and thereafter a wide image 2 having a width b as shown in FIG. 1B is developed, the above-mentioned portion 4 of the image 2 is developed with developer particles disposed on a portion of a developer-carrying member such as a sleeve corresponding to a white background outside of the image 1 region, whereby the image portion 4 is provided with a density lower than the other image region as shown in FIG. 1C. When the developer-carrying member effects one rotation in order to develop the image 2, the developer particles disposed on the portion of the developer-carrying member corresponding to the width b is consumed. As a result, in an image portion 3 formed after the one rotation (corresponding to a length 1 in FIG. 1C) of the developer-carrying member, the image density is uniformized.

According to our investigations, it has been found that the mechanism by which the above-mentioned memory phenomenon occurs closely relates to a layer of fine powder (predominantly comprising particles having a particle size of 4 microns or smaller) formed on a developer-carrying member.

More specifically, according to our investigation, it has been found that there occurs a clear difference between a portion subjected to developer consumption and a portion not subjected to developer consumption, with respect to the particle size distribution of developer particles constituting a lowest layer portion (i.e., a layer portion disposed closest to the developer-carrying member) of the developer layer formed on the developer-carrying member. Accordingly, in the portion not subjected to the developer consumption, a layer of fine powder is formed in the lowest developer layer. Because such fine particles have a large surface area per unit volume, the fine particle has a larger triboelectric charge amount per unit weight as compared with a particle having a large particle size, and is strongly electrostatically constrained to the developer-carrying member due to its mirror image force. Accordingly, the developer disposed on the fine powder layer is not sufficiently charged by the developer-carrying member triboelectrically, and the triboelectric charge amount imparted thereto is decreased. As a result, such a phenomenon appears as the developer-carrying member memory phenomenon, i.e., the image density is partially decreased, in the resultant image.

With respect to the addition of resin particles, while their function is different from that in the present invention, Japanese Laid-Open Patent Application (KOKAI) NO. 186854/1985 proposes that polymer resin particles smaller than toner particles are added to the toner particles. When a developer was prepared in the same manner as in this Patent Application and was investigated, it was found that the above-mentioned resin particles lowered their effect in a successive copying test, while they show somewhat effect on the developer-carrying member memory phenomenon in the initial stage. When the chargeability of the resin particles was investigated, it was found that the resin particles having triboelectric chargeability with the same polarity as the toner showed no effect and those having the reverse polarity showed less effect as their chargeability became weaker.

While the function is different from that in the present invention, Japanese Laid-Open Patent Application No. 250658/1986 proposes that particles having the reverse polarity (e.g., negatively chargeable silicon dioxide fine particles with respect to a positively chargeable toner) and particles having the same polarity (e.g., positively chargeable silicon dioxide fine particles with respect to a positively chargeable toner) are added to the toner. When a developer was prepared in the same manner as in this Patent Application and was investigated, it was found that the above-mentioned resin particles did not show so much effect on the developer-carrying member memory phenomenon and the resultant image density was low. Further, when the copying operation was successively conducted, fine particles, which appeared to be those having the reverse polarity, were accumulated in a cleaner portion and the photosensitive member was damaged. As a result, there is still room for improvement.

Recently, the electrophotographic system has also been used for a printer as an output device for computer in addition to the production of copied images. In the case of the printer, a light-emitting device such as a semiconductor laser is turned on and off corresponding to an image signal, and the resultant light is supplied to a photosensitive member. In such case, because the printing proportion (i.e., the proportion of a printed area to the whole area per unit sheet) is ordinarily 30% or below, the reversal development system wherein a portion to be used for letter formation is subjected to exposure is advantageous in view of the life of the light-emitting device.

Hitherto, in electrophotographic apparatus, there has generally been adopted the normal development system wherein a non-exposed portion of a photosensitive member is developed (i.e., provided with toner particles). In this system, because the reflection light from an original is optically processed and supplied to the photosensitive member, the non-exposed portion thereof provided with substantially no reflection light (i.e., a portion corresponding to the letter or image portion of the original) is developed.

On the other hand, in the reversal development method, the exposed portion is developed as described hereinabove. The reversal development method has been used in an apparatus (such as a microfilm output device) capable of outputting positive and negative images from the same original, and has also been used in an apparatus wherein the normal development system and reversal development system are used in combination in order to effect development for two or more colors.

However, the reversal development system can pose a problem as follows.

Thus, in the ordinary or normal development, the transfer electric field (or electric field for transfer) has the same polarity as that of the primary charging. Therefore, even when the transfer electric field is applied to a photosensitive member after the passage of an image-supporting member or transfer material (such as plain paper and plastic film), the effect thereof is removed by erasing exposure 106 in FIG. 5 described hereinafter.

On the other hand, in the reversal development, the transfer electric field has a polarity reverse to that of the primary charging. Therefore, when the transfer electric field is applied to a photosensitive member after the passage of transfer material such as plain paper, the photosensitive member is charged to have a polarity reverse to that of the primary charging, and the effect thereof cannot removed by the erasing exposure. As a result, the portion which as been changed to have the reverse polarity appears as an increase in image density in the resultant image. Such a phenomenon is referred to as "afterimage caused by paper".

In order to obviate such afterimage, Japanese Laid-Open Patent Application No. 256173/1985 proposes a method wherein the current for providing a transfer electric field is reduced after the passage of paper. However, this method requires various parts such as microswitch, and the apparatus therefor becomes complicated and the apparatus cost becomes high.

There is conceivable a method wherein the transfer electric field is reduced to a certain extent so as not to charge the photosensitive member to have the reverse polarity. However, because such a method lowers the transfer efficiency, there occurs a decrease in image quality due to transfer failure.

The reversal development method can pose another problem. More specifically, because the photosensitive member is charged to have a polarity reverse to that of paper, when a strong electric field is used for charging, the paper is electrostatically attached to the photosensitive member and cannot be separated therefrom even after the completion of the transfer step. As a result, the paper is subjected to the next step such as cleaning step to cause paper jam. Such a phenomenon is referred to as "paper winding".

In order to prevent the paper winding, Japanese Laid-Open Patent Application No. 60470/1981 (corr. to U.S. Pat. No. 4353648) proposes a method wherein small insulating particles which have been charged to have a polarity reverse to that of a toner image are preliminarily attached to a photosensitive member surface in order to prevent close contact between the photosensitive member and paper. However, this method is not necessarily effective in the reversal development system. The reason for this may be considered that the contact between the photosensitive member and paper at the time of separation in the transfer step of the reversal development system is closer than that in the normal development system.

U.S. Pat. No. 3,357,400 discloses another device equipped with a separation charge device or a belt separation device as a means for supplementing the separation. Such a device is effective in preventing the winding phenomenon but is not substantially effective in preventing the afterimage caused by paper. This may be attributable to a fact that the separation charging is weaker than the transfer charging and does not substantially affect the potential of the photosensitive member.

There is another method wherein the transfer electric field is reduced so as to lower electrostatic adhesion force. However, this method is liable to cause a decrease in image quality due to transfer failure, as described above. When the transfer electric field is reduced, the transfer efficiency decreases so that a postcard or an OHP film (i.e., a transparent film for an overhead projector) which is disadvantageous in the transfer step cannot be used satisfactorily as a transfer material. Further, when the transfer electric field is reduced, there occurs "partially white image (e.g., hollow characters)", a kind of transfer failure, with respect to a portion (i.e., edge development portion) such as an image contour portion or line image portion at which developer particles are liable to be collected. The reason for this may be considered that a larger amount of developer particles are attached to the edge development portion as compared with a normal portion and the developer particles are liable to agglomerate, whereby the responsiveness to the transfer electric field is lowered. As a result, there occurs a problem that it become difficult to obtain a high-quality image faithful to a latent image.

SUMMARY OF THE INVENTION

A principal object of the present invention is to provide a developer which has solved the above-mentioned problems.

Another object of the present invention is to provide a negatively chargeable magnetic developer which is capable of forming a uniform layer on a developer-carrying member and is capable of preventing a memory phenomenon in the developer-carrying member.

A further object of the present invention is to provide a negatively chargeable magnetic developer which is capable of preventing developer deterioration due to accumulation of fine powder in a developing device.

A further object of the present invention is to provide a negatively chargeable magnetic developer which has an excellent imaging characteristic and is capable of providing a clear image having a high image density.

A further object of the present invention is to provide a one-component type negatively chargeable magnetic developer which is capable of providing a stable triboelectric charge amount based on friction between toner particles and between toner particle and a developer-carrying member such as sleeve, is capable of providing a sharp and uniform triboelectric charge amount distribution, and is capable of preventing the accumulation and attachment of fine toner powder to the non-image portion of a developer-carrying member so as to prevent a memory phenomenon.

A further object of the present invention is to provide a one-component type negatively chargeable magnetic developer capable of reproducing a stable image without being affected by change in temperature and humidity.

A further object of the present invention is to provide a one-component type negatively chargeable magnetic developer with excellent storage stability which can retain initial characteristics even after a long period of successive use.

A further object of the present invention is to provide an image forming method which is capable of forming an image with a high image density and less fog by using a developer containing a negatively chargeable magnetic toner.

A further object of the present invention is to provide an image forming method which is usable for an image forming system such as reversal development system wherein a transfer step using a low transfer electric field is required, and includes a transfer step which is capable of providing a high-quality image faithful to a latent image regardless of conditions for a transfer supporting member.

A further object of the present invention is to provide an image forming method wherein a phenomenon such as the above-mentioned "afterimage caused by paper", "paper winding" or "partially white image (e.g., hollow characters)" is prevented or suppressed.

A further object of the present invention is to provide an image forming method which uses a developer capable of providing a high-quality image without fog even on a thick transfer paper.

A further object of the present invention is to provide an image forming method using a one-component negatively chargeable magnetic developer which is stable under an environmental change including high temperature-high humidity and low temperature-low humidity conditions, and is capable of constantly exhibiting a good characteristic.

A further object of the present invention is to provide an image forming method using a one-component negatively chargeable magnetic developer which is suitable for developing a digital latent image used in an image forming apparatus such as digital copying machine and laser beam printer.

A still further object of the present invention is to provide an image forming method which does not cause a partially white image even under a low electric field such as one used in a reversal development device, and is excellent in durability.

According to the present invention, there is provided a developer for developing electrostatic images, comprising, at least, 100 wt. parts of a negatively chargeable magnetic toner having a volume-average particle size of 5 to 30 microns; 0.1 to 3 wt. parts of positively chargeable resin particles having an average particle size of 0.1 to 1.0 micron; and 0.05 to 3 wt. parts of hydrophobic silica fine powder having a triboelectric chargeability of $-100$ to $-300$ $\mu c/g$.

The present invention also provides an image forming method, comprising:

providing an electrostatic image-bearing member having thereon an electrostatic image, and a developer-carrying member for carrying thereon an insulating magnetic developer, which contains therein magnetic field generation means and is disposed opposite to the electrostatic image-bearing member with a prescribed clearance; wherein the insulating magnetic developer comprises, at least, 100 wt. parts of a negatively chargeable magnetic toner having a volume-average particle size of 5 to 30 microns, 0.1 to 3 wt. parts of positively chargeable resin particles having an average particle size of 0.1 to 1.0 micron, and 0.05 to 3 wt. parts of hydrophobic silica fine powder having a triboelectric chargeability of −100 to −300 μc/g;

triboelectrically charging the negatively chargeable magnetic toner so that it is provided with a negative charge;

applying the negatively chargeable magnetic developer containing the negatively charged magnetic toner onto the developer-carrying member by means of a regulation member disposed close to the developer-carrying member, thereby to form thereon a layer of the developer having a thickness smaller than the clearance; and transferring the insulating magnetic developer to the electrostatic image-bearing member under a magnetic field generated by the magnetic field generation means while applying an alternating or pulse electric field between the electrostatic image-bearing member and the developer-carrying member, thereby to develop the electrostatic image.

The present invention further provides an image forming method, comprising: developing an electrostatic image formed on an electrostatic image-bearing member with a developer to form a toner image thereon, wherein the developer is a one-component type developer comprising a negatively chargeable toner and positively chargeable resin particles having an average particle size of 0.1 to 1.0 micron and a triboelectric chargeability of +50 to +600 μc/g; and electrostatically transferring the toner image from the electrostatic image-bearing member to a transfer material under a condition such that the ratio (Vtr/Vpr) of a primary charging electric field Vpr to a transfer electric field Vtr is negative.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figures 1A, 1B, 1C:
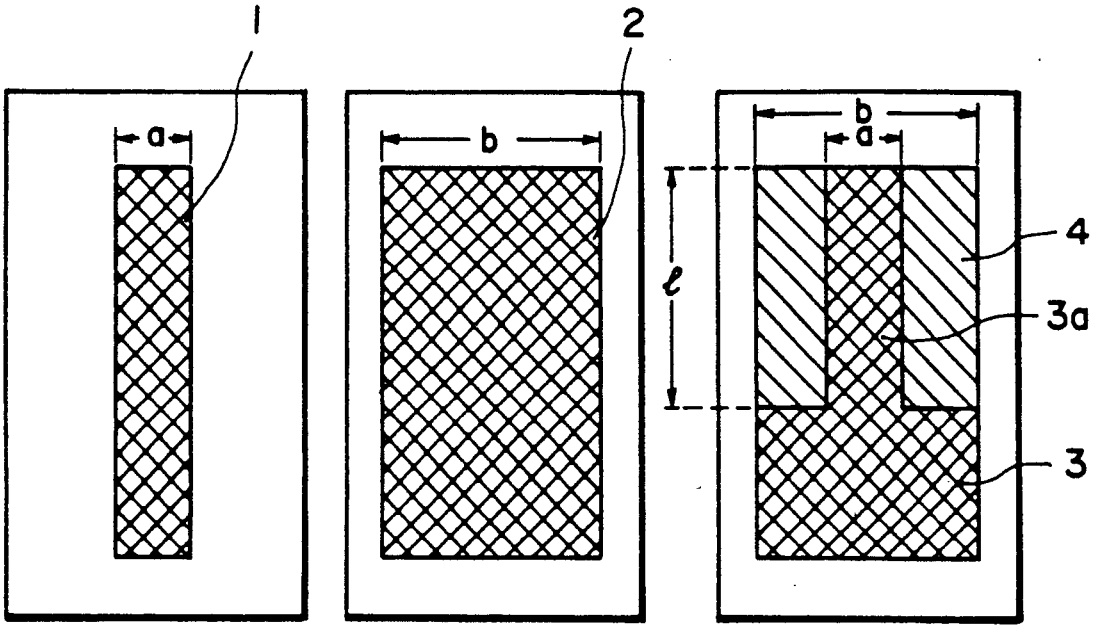
FIGS. 1A, 1B and 1C are schematic views for illustrating a memory phenomenon in a developer-carrying member.

We have found that a satisfactory developer is obtained by adding positively chargeable resin particles and negatively chargeable silica fine particles to a one-component type developer.

The positively chargeable resin particles used in the present invention may preferably have a triboelectric chargeability such that they have a triboelectric charge amount of +50 μc/g to +600 μc/g, more preferably +100 μc/g to +600 μc/g.

When resin particles having a triboelectric chargeability of below 50 μc/g are added, the effect of addition is a little and the above-mentioned memory phenomenon is little suppressed, whereby a decrease in image density is liable to occur. When resin particles having a triboelectric chargeability of above +600 μc/g are added, the reverse polarity is strong whereby fog tends to occur in a non-image portion or a line image tends to be thinner.

It is considered that the above-mentioned resin particles are attached to toner particle surfaces due to electrostatic force in a developer, and form clearance between toner particles and between toner particle and a photosensitive member to reduce the adhesion force therebetween, whereby electrostatic transfer is well conducted.

The triboelectric chargeability of the positively chargeable resin particles may be determined in the following manner in terms of a triboelectric charge amount. That is, 0.2 g of resin particles which have been left to stand overnight in an environment of 25° C. and relative humidity of 50 to 60% RH, and 99.8 g of carrier iron powder not coated with a resin having a mode particle size of 200 to 300 mesh (e.g. EFV 200/300, produced by Nippon Teppun K.K.) are mixed in an aluminum pot having a volume of about 200 cc in the same environment as mentioned above by means of a turbula mixer (3 times/sec.) for 60 min., and the triboelectric charge of the resin particles is measured according to the conventional blow-off method by means of an aluminum cell having a 400 mesh-screen under a blow pressure of 0.5 kg/cm$^2$.

The positively chargeable resin particles may preferably have a primary average particle size of 0.1 to 1.0 microns, more preferably 0.2 to 1.0 microns. The resin particles having an average particle size of below 0.1 microns only have a little effect on the memory phenomenon and insufficiently improve the transfer efficiency. The resin particles having an average particle of above 1.0 micron are liable to be freed from the toner particle surface and invite fog in the form of black spots in a non-image portion.

The average particle size may be measured by means of a Coulter Counter N4 (mfd. by Nikkaki K.K.) in a state wherein they are dispersed in a solvent by ultrasonic vibrations. The average particle size may also be measured a measurement device Model: CAPA-500 (mfd. by Horiba Seisakusho K.K.). Further, the average particle size of resin particles which practically have a particle size distribution of monodisperse system and are obtainable through a process such as a polymerization process may directly be measured by using a scanning electron microscope photograph or SEM image, (magnification: 7,500 to 10,000).

The positively chargeable fine resin particles may preferably be added to the toner in an amount of 0.1 to 3.0 wt. parts, more preferably 0.2–3.0 wt. parts, per 100 wt. parts of the toner. Below 0.1 wt. part, their effect on the memory phenomenon is little, and above 3.0 wt. parts, free particles are liable to occur and fog in the form of black spots are liable to be invited in a non-image portion.

The positively chargeable fine resin particles used in the present invention may preferably be spherical. More specifically, those having a ratio of the longer diameter to the shorter diameter (longer diameter/shorter diameter) of 1.0 to 1.02 are preferred because such particles are excellent in preventing or suppressing the memory phenomenon.

The positively chargeable fine resin particles used in the present invention may be produced by a production process such as spray-drying method, suspension polymerization, emulsion polymerization and seed polymerization. In view of shape-retaining property of the particle, the positively chargeable resin particles may preferably comprise a resin having a weight-average molecular weight of 10,000 to 200,000 according to a GPC (gel permeation chromatography) method.

The fine resin particles may be those obtained by polymerizing a vinyl monomer or a mixture thereof. Examples of the vinyl monomer may include methyl methacrylate, dimethylaminoethyl methacrylate, diethylaminoethyl methacrylate, N-methyl-N-phenylaminoethyl methacrylate, diethylaminoethyl methacrylamide, dimethylaminoethyl methacrylamide, 4-vinylpyridine, and 2-vinylpyridine. In order to impart positive chargeability to the resin particles, there may be used a method wherein a monomer is polymerized by using a nitrogen-containing polymerization initiator, or a monomer composition comprising a nitrogen-containing vinyl monomer is polymerized.

Resin particles having an average particle size of 0.1–1.0 micron may be produced by spray-drying method, suspension polymerization, emulsion polymerization, soap-free polymerization, and seed polymerization. Among these, the soap-free polymerization is particularly preferred because no emulsifier remain in the resultant resin particles, and therefore the chargeability of the toner is not impaired and a polymer particles having a narrow particle size distribution are obtained.

Further, the spherical fine resin particles may preferably have a specific electric resistance of $10^8$–$10^{14}$ ohm.cm. in view of environmental dependency and stability in imaging characteristic. When resin particles having a specific electric resistance of below $10^8$ ohm.cm. are used, the charge amount provided to the toner particles is remarkably decreased, whereby the resultant image density is decreased. When resin particles having a specific electric resistance of above $10^{14}$ ohm.cm. are used, fog in the form of black spots is liable to occur in the non-image portion of paper due to flying of the toner particles. The reason for this is not necessarily clear but can be considered that the charge amount of the spherical fine resin particles is remarkably increased and subjected to reversal development while they are electrostatically attached to the toner particle which is present in the neighborhood of the fine particles.

Figure 4:
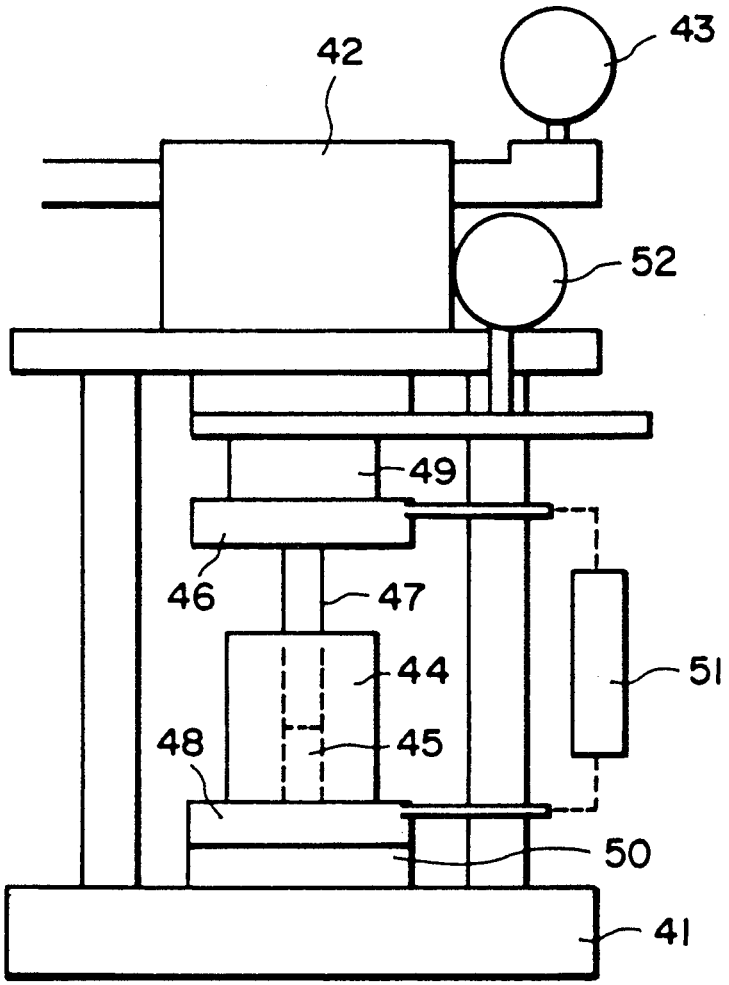
FIG. 4 is a schematic sectional view showing a device for measuring a volume resistivity of a sample.

In the present invention, the specific electric resistance (or volume resistivity) may for example be measured by means of a device as shown in FIG. 4. Referring to FIG. 4, reference numeral 41 denotes a mounting member and numeral 42 denotes a pressing means which is connected to a hand press and is equipped with a pressure gauge 43. Numeral 44 denotes a hard glass cell with a diameter of 3.100 cm wherein a sample 45 is charged. Numeral 46 denotes a press ram of brass having a diameter of 4.266 cm and an area of 14.2857 $cm^2$, and numeral 48 denotes a push rod having a radius of 0.397 cm and an area of 0.496 $cm^2$ and applying a pressure from the press ram 46 to the sample 45. Numeral 48 denotes a mounting member of brass and numerals 49 and 50 denote insulating plates of bakelite, and numeral 51 denotes a resistance meter connected to the press ram 46 and the mounting member 48. Numeral 52 denotes a dial gauge.

In the device shown in FIG. 4, when an oil pressure of 20 $kg/cm^2$ is applied to the hand press, a pressure of 576 $kg/cm^2$ is applied to the sample 45. The resistance is read by means of the resistance meter 51, and it is multiplied by the sectional area of the sample 45 and divided by the height of the sample 45 read in the dial gauge 52, whereby the volume resistivity is obtained.

The spherical resin particles are required to have positive chargeability and may be surface-treated as desired. The surface treatment method may include: one wherein the resin particles is surface-treated with a metal such as iron, nickel, cobalt, copper, zinc, gold and silver; one wherein the above-mentioned metal or a metal oxide such as magnetic material and electroconductive zinc oxide is fixed to the resin particles by ion adsorption or external addition; or one wherein a triboelectrically chargeable pigment, dye or a polymer resin is carried on the resin particles by coating or external addition.

The binder resin for the magnetic toner of the present invention may be composed of homopolymers of styrene and derivatives thereof such as polystyrene and polyvinyltoluene; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methylether copolymer, styrene-vinyl ethyl ether copolymer, styrene-vinyl methyl ketone copolymer, styrenebutadiene copolymer, styrene-isoprene copolymer, styrene-maleic copolymer, and styrene-maleic acid ester copolymer; vinyl polymers or copolymers such as polymethyl methacrylate, polybutyl methacrylate, polyvinyl acetate, polyethylene, polypropylene, polyesters, polyurethanes, polyamides, epoxy resins, polyvinyl butyral, polyacrylic acid resin and mixtures thereof. Further, there may be used rosin, modified rosins, terpene resin, phenolic resins, aliphatic or alicyclic hydrocarbon resins, aromatic petroleum resin, paraffin wax, carnauba wax etc. These binder resins may be used either singly or as a mixture.

Among these, in the present invention, the binder may preferably comprise a styrene-acrylic resin-type copolymer (inclusive of styrene-acrylic acid ester copolymer and styrene-methacrylic acid ester copolymer). Particularly preferred examples include styrene-n-butyl acrylate (St-nBA) copolymer, styrene-n-butyl methacrylate (St-nBMA) copolymer, styrene-n-butyl acrylate-2-ethylhexyl methacrylate copolymer St-nBA-2EHMA) copolymer in view of the developing characteristic, triboelectric chargeability and fixing characteristic of the resultant toner.

The terahydrofuran (THF)-soluble of the binder resin may preferably have a weight-average molecular weight of 100,000 to 2,000,000. The binder resin content may preferably be 30 to 90 wt.% based on the weight of the magnetic toner, in view of the developing characteristic and fixing characteristic of the magnetic toner.

The magnetic toner of the present invention can further contain an optional colorant such as known carbon black, copper phthalocyanine, and iron black.

The magnetic material contained in the magnetic toner of the present invention may be a substance which is magnetizable under a magnetic field including: powder of a ferromagnetic metal such as iron, cobalt and nickel; or an alloy or compound such as magnetite, $\gamma$-$Fe_2O_3$, and ferrite. The magnetic fine powder may preferably have a BET specific surface area of 2-10 $m^2/g$, more preferably 2.5-12 $m^2/g$, and may further preferably have a Mohs' scale of hardness of 5-7. The magnetic powder content may preferably be 10-70 wt.% based on the toner weight.

The toner according to the present invention may also contain as desired, a charge controller (or charge-controlling agent) including a negative charge controller such as a metal complex salt of a monoazo dye; and a metal complex of salicylic acid, alkylsalicylic acid, dialkylsalicylic acid, or naphthoic acid, etc. The toner of the present invention may preferably contain 0.1-10 wt. parts, more preferably 0.1-5 wt. parts, of the charge controller, per 100 wt. parts of a binder resin.

The magnetic toner of the present invention may preferably have a volume resistivity of $10^{10}$ ohm/cm or more, more preferably $10^{12}$ ohm/cm or more, particularly preferably $10^{14}$ ohm/cm or more, in view of triboelectric chargeability and electrostatic transfer characteristic. The volume resistivity used herein may be determined in the following manner. Thus, the toner is shaped to a sample having an area of 2 $cm^2$ and a thickness of about 5 mm under a pressure of 100 $kg/cm^2$ for 5 min., and an electric field of 100 V/cm is applied thereto. After 1 min. counted from the application of the electric field, the amount of the current passing through the shaped toner is measured and converted into a volume resistivity.

The negatively chargeable magnetic toner according to the present invention may preferably provide a triboelectric charge amount of $-8$ $\mu c/g$ to $-40$ $\mu c/g$, more preferably $-8$ $\mu c/g$ to $-20$ $\mu c/g$. If the charge amount of less than $-8$ $\mu c/g$ (in terms of the absolute value thereof), the image density is liable to decrease, particularly under a high humidity condition. If the charge amount is more than $-40$ $\mu c/g$, the toner is excessively charged to make a line image thinner, whereby only a poor image is provided particularly under a low humidity condition.

The negatively chargeable toner particles of the present invention are defined as follows. That is, 10 g of toner particles which have been left to stand overnight in an environment of 25° C. and relative humidity of 50 to 60% RH, and 90 g of carrier iron powder not coated with a resin having a mode particle size of 200 to 300 mesh (e.g. EFV 200/300, produced by Nippon Teppun K.K.) are mixed thoroughly in an aluminum pot having a volume of about 200 cc in the same environment as mentioned above (by shaking the pot in hands vertically for about 50 times), and the triboelectric charge of the toner particles is measured according to the conventional blow-off method by means of an aluminum cell having a 400 mesh-screen. The toner particles having negative triboelectric charge through the above measurement are defined as negatively chargeable toner particles.

The toner particles may preferably have a volume-average particle size of 5-30 microns, more preferably 6-15 microns, particularly preferably 7-15 microns. The toner particles may preferably have a number-basis particle size distribution such that they contain 1-25% by number, more preferably 2 to 20% by number, particularly preferably 2 to 18% by number, of toner particles having a particle size of 4 microns or smaller.

In the present invention, the particle distribution of the toner may be measured by means of a Coulter counter.

Coulter counter Model TA-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 0.5 to 50 mg of a sample is added thereto. The resultant dispersion of the sample in the electrolytic liquid is subjected to a dispersion treatment for about 1-3 minutes by means of an ultrasonic disperser, and then subjected to measurement of particle size distribution in the range of 2-40 microns by using the above-mentioned Coulter counter Model TA-II with a 100 micron-aperture to obtain a volume-basis distribution and a number-basis distribution. From the results of the volume-basis distribution and number-basis distribution, parameters characterizing the magnetic toner of the present invention may be obtained.

The negatively chargeable silica fine powder used in the present invention may preferably be one providing a triboelectric charge amount of $-100$ $\mu c/g$ to $-300$ $\mu c/g$, and may preferably have a BET specific surface area 70-300 $m^2/g$ (corresponding to a primary average particle size of 5 microns to 30 microns) according to nitrogen adsorption. When the triboelectric charge amount is below $-100$ $\mu c/g$, the silica fine powder lowers the triboelectric chargeability of the developer per se, and lowers the humidity-resistance. When the triboelectric charge amount is above $-300$ $\mu c/g$, the memory phenomenon in a developer-carrying member is promoted, and the developer is easily affected by toner deterioration due to silica, whereby the durability is obstructed. When the BET specific surface area is larger than 300 $m^2/g$, the effect of addition on the developer is little. When the BET specific surface area is smaller than 70 $m^2/g$, the silica fine particles easily become free particles, and are liable to be localized and to cause black spots due to agglomerates thereof.

The triboelectric charge amount of the negatively chargeable silica a fine powder in the present invention may be measured in the following manner. That is, 2 g of silica fine powder which has been left to stand overnight in an environment of 25° C. and relative humidity of 50 to 60% RH, and 98 g of carrier iron powder not coated with a resin having a mode particle size of 200 to 300 mesh (e.g. EFV 200/300, produced by Nippon Teppun K.K.) are mixed thoroughly in an aluminum pot having a volume of about 200 cc in the same environment as mentioned above (by shaking the pot in hands vertically for about 50 times).

Figure 3:
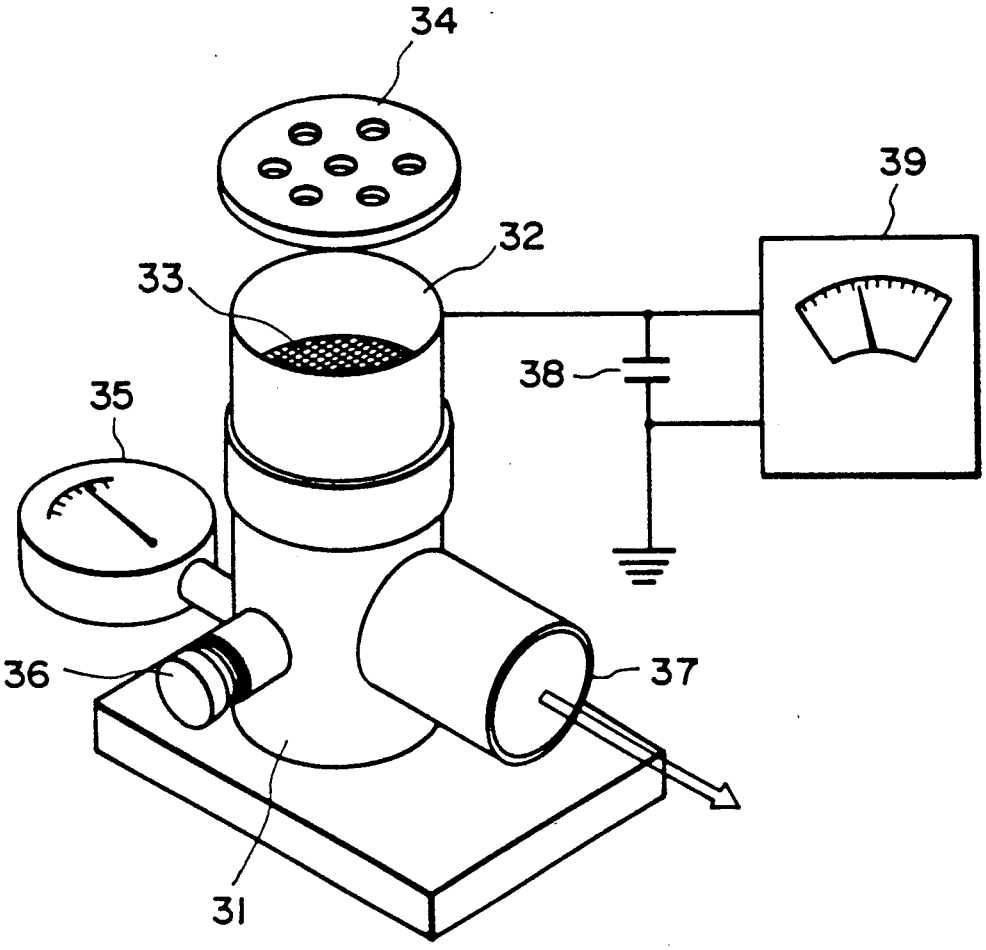
FIG. 3 is a schematic perspective view showing a device for measuring a triboelectric charge amount of a sample such as silica fine particles used in the present invention.

Then, referring to FIG. 3, about 0.5 g of the shaked mixture is charged in a metal container 32 for measurement provided with a 400-mesh screen 33 at the bottom, and covered with a metal lid 34. The total weight of the container 32 is weighed and denoted by $W_1$ (g). Then, an aspirator 31 composed of an insulating material at least with respect to a part contacting the container 32 is operated, and the silica in the container is removed by suction through a suction port 37 sufficiently while controlling the pressure at a vacuum gauge 35 at 250 mm.Hg by adjusting an aspiration control valve 36. The reading at this time of a potential meter 39 connected to the container by the medium of a capacitor having a capacitance C ($\mu$F) is denoted by V (volts). The total weight of the container after the aspiration is measured and denoted by $W_2$ (g). Then, the triboelectric charge ($\mu$c/g) of the silica is calculated as: $CxV/(W_1-W_2)$.

The silica fine powder used in the present invention can be "dry process silica" or "fumed silica" produced through vapor phase oxidation of a silicon halide, or "wet process silica" produced from a material such as water glass. The dry process silica is preferred because it has a relatively small number of silanol groups and provides no production residue.

In the production process for the dry process silica, it is also possible to obtain complex fine powder of silica and other metal oxides by using other metal halide compounds such as aluminum chloride or titanium chloride together with a silicon halide compound. Such complex fine powder is also included in the fine silica powder to be used in the present invention.

The silica fine powder used in the present invention may be one imparted with a hydrophobicity. In order to impart hydrophobicity to the silica fine powder, known treatment methods may be used. For example, the hydrophobicity is imparted thereto by chemically treating silica fine powder with a material such as organosilicon compound capable of reacting therewith or of physically being adsorbed thereinto.

In the present invention, there is preferred a method wherein silica fine powder produced through vapor phase oxidation of a silicon halide is treated with a silane coupling agent and/or a silicone oil. Particularly preferably, silica fine powder is treated with a silane coupling agent and thereafter is treated with a silicone oil. Preferred examples of the silane coupling agent may include hexamethyldisilazane (HMDS).

The silicone oil used herein may preferably have a viscosity at 25° C. of about 50–1,000 centistokes. Preferred examples thereof may include: dimethylsilicone oil, methylphenylsilicone oil, $\alpha$-methylstyrene-modified silicone oil, chlorophenylsilicone oil, and fluorine-modified silicone oil. In order to effectively attain the object of the present invention, a silicone oil containing a large amount of —OH, —COOH or —$NH_2$ group is not preferred.

In order to treat silica fine powder with a silicone oil, a known method may be used. There may for example be used a method wherein silica fine powder is directly mixed with a silicone oil by means of a mixer such as Henschel mixer; a method wherein a silicone oil is sprayed on silica fine powder as a base material; or a method wherein a silicone oil is dissolved or dispersed in an appropriate solvent and mixed with silica fine powder as a base material, and then the solvent is removed.

The silica fine powder may preferably be subjected to a hydrophobicity-imparting treatment so that it finally has a hydrophobicity of 30–80 as measured by a methanol titration test, because a developer containing such silica fine powder may show a negative chargeability such that it has a sharp and uniform distribution of triboelectric charge amount.

The hydrophobicity of silica fine powder having a surface imparted with a hydrophobicity is measured by the methanol titration test, which is conducted as follows.

Sample silica fine powder (0.2 g) is charged into 50 ml of water in a 250 ml-Erlenmeyer's flask. Methanol is added dropwise from a buret until the whole amount of the silica is wetted therewith. During this operation, the content in the flask is constantly stirred by means of a magnetic stirrer. The end point can be observed when the total amount of the fine silica particles is suspended in the liquid, and the hydrophobicity is represented by the percentage of the methanol in the liquid mixture of water and methanol on reaching the end point.

The silica fine powder shows an effect when added in an amount of 0.05–3 wt. parts and more preferably may be used in an amount of 0.1–2 wt. parts, respectively with respect to 100 wt. parts of the toner, in order to obtain a developer showing a chargeability with excellent stability. As a preferred mode of addition, the treated silica powder in an amount of 0.01–1 wt. parts with respect to 100 wt. parts of the toner should preferably be in the form of being attached to the surface of the toner particles.

The wt. ratio of the above-mentioned silica to the resin particles may preferably be (silica):(resin particles)=1:0.1 to 1:100. When the wt. ratio of the resin particles to the silica is below 0.1, the effect thereof on fog is a little. When the wt. ratio is above 100, a decrease in image density is invited.

The developer according to the present invention may provide better results when it has a relatively high agglomeration degree as compared with an ordinary negatively chargeable one-component developer. The one-component developer of the present invention may preferably provide an agglomeration degree of 70–95%. When the agglomeration degree is below 75%, the memory phenomenon is liable to occur in a developer-carrying member. When the agglomeration degree is above 95%, the image density is liable to decrease.

The agglomeration degree used herein may be measured in the following manner.

As an instrument for measurement, Powder Tester (available from Hosokawa Micron K.K.) is used.

For measurement, a 60-mesh sieve, a 100-mesh sieve and a 200-mesh sieve are superposed in this order from the above and set on a vibration table. An accurately measured sample in an amount of about 2 g is placed on the 60-mesh sieve, and the vibration table is subjected to vibration for about 40 seconds while applying a voltage of 2.5 V to the Powder Tester. Then, the weight of powder remaining on the 60-mesh sieve (a g), the weight of powder remaining on the 100-mesh sieve (b g), and the weight of powder remaining on the 200-mesh sieve (c g) are measured to calculate the agglomeration degree from the following equation:

$$\text{Agglomeration degree } (\%) = (a + b \times 0.6 + cx0.2)/2$$

When the developer does not have a suitable agglomeration degree, the developer is liable to cause coating failure on a sleeve. The coating failure may be determined by observing with eyes whether a linear white streak is present in the resultant toner image. The reason for the white streak formation in the toner image may be considered that agglomerates of toner or developer occur in a hopper and they cause a portion on a sleeve not coated with the toner, and such a portion causes a defect in the resultant toner image which should originally be provided with toner but is actually provided with no toner.

The developer of the present invention can further contain an optional additive as long as it does not substantially have ill effect on the developer. Examples of such an additive may include: a lubricant such as teflon and zinc stearate; a fixing aid such as low-molecular weight polyethylene; and a conductivity-imparting agent including a metal oxide such as tin oxide.

The toner of the present invention may for example be prepared in the following manner.

[Pulverization Process]

(1) A binder resin and a magnetic material are blended by uniform dispersion by means of a blender such as Henschel mixer together with optionally added dye or pigment as a colorant.

(2) The above blended mixture is subjected to melt-kneading by using a kneading means such as a kneader, extruder, or roller mill.

(3) The kneaded product is coarsely crushed by means of a crusher such a cutter mill or hammer mill and then finely pulverized by means of a pulverizer such as a jet mill.

(4) The finely pulverized product is subjected to classification for providing a prescribed particle size distribution by means of a classifier such as a zigzag classifier, thereby to provide a toner.

As another process for producing the toner of the present invention, the polymerization process or the encapsulation process, etc., can be used. The outline of these processes is summarized as follows.

[Polymerization Process]

(1) A monomer composition comprising a polymerizable monomer and optionally a polymerization initiator and a colorant, may be dispersed into particles in an aqueous dispersion medium.

(2) The particles of the monomer composition are classified into an appropriate particle size range.

(3) The monomer composition particles within a prescribed particle size range after the classification is subjected to polymerization.

(4) After the removal of a dispersant through an appropriate treatment, the polymerized product is filtered, washed with water and dried to obtain a toner.

[Encapsulation Process]

(1) A binder resin and a magnetic material and optionally a colorant are melt-kneaded to form a toner core material in a molten state.

(2) The toner core material is stirred vigorously in water to form fine particles of the core material.

(3) The fine core particles are dispersed in a solution of a shell material, and a poor solvent is added thereto under stirring to coat the core particle surfaces with the shell material to effect encapsulation.

(4) The capsules obtained above are recovered through filtration and drying to obtain a toner.

The developer according to the present invention is applicable to various developing methods, but may preferably be applied to a developing method as described below.

Figure 2:
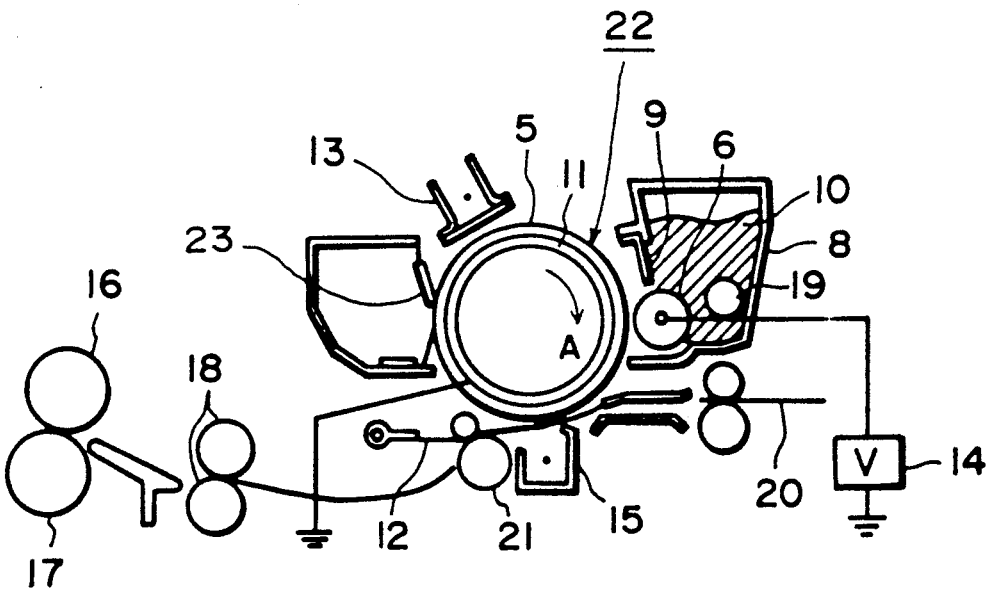
FIG. 2 is a schematic sectional view showing an embodiment of the image forming apparatus to which the present invention is applicable.

FIG. 2 is a schematic sectional view of an image forming apparatus for practicing a developing step to which the developer of the present invention is applicable.

Referring to FIG. 2, a photosensitive drum 22, as an electrostatic image-bearing member, comprises a photosensitive layer 5 and an electroconductive substrate 11, and moves in the direction of an arrow A. On the other hand, the developing sleeve 6 of a nonmagnetic cylinder, as a developer-carrying member, rotates so as to move in the same direction as that of the photosensitive drum 22 in a developing position where the sleeve 6 is disposed opposite to the photosensitive member 22. A multipolar permanent magnet (not shown) is disposed inside the nonmagnetic cylinder 6 so as not to rotate.

A one-component insulating magnetic developer 10 contained in a developing apparatus 8 is applied onto the nonmagnetic sleeve 6, and the toner particles contained therein are supplied with triboelectric charge on the basis of the friction between the cylindrical sleeve surface and the toner particles (and/or between toner particles to which silica fine powder has been externally added). A magnetic doctor blade 9 of iron is disposed close to the sleeve surface (preferably with a clearance of 50–500 microns) and opposite to one of the poles of the multipolar permanent magnet. Thus, the thickness of the toner layer disposed on the sleeve 6 is regulated uniformly and thinly (preferably in a thickness of 30–300 microns), thereby to form a developer layer having a thickness smaller than the clearance between the photosensitive drum 22 and the sleeve 6 in the developing position. The rotating speed of the sleeve 6 may be regulated so that the speed of the surface thereof is substantially the same as (or close to) the speed of the photosensitive drum 22 surface.

The magnetic doctor blade 9 may also comprise a permanent magnet instead of iron thereby to form a counter magnetic pole. In the developing position, an AC bias or pulse bias may be applied between the sleeve 6 and the photosensitive drum 22 by means of bias application means 14. The AC bias may preferably have a frequency of 200–4,000 Hz, and a Vpp (peak-to-peak value) of 500–3,000 V.

In the above-mentioned developing step, there is used the non-magnetic cylindrical sleeve 6 containing therein the multipolar permanent magnet, in order to stably carry the one-component magnetic developer 10 on the sleeve 6. Further, in order to form a uniformly thin developer layer on the sleeve 6, the doctor blade 9 comprising a thin plate of a magnetic material or a permanent magnet is disposed close to the sleeve 6 surface. When the magnetic doctor blade 9 is used in such a manner, opposed magnetic poles are formed by the doctor blade 9 and the magnetic pole of the permanent magnet disposed inside the sleeve 6, and chains composed of toner particles are forcibly erected therebetween. Such erection is advantageous in order to thinly control the developer layer disposed in another portion such as the developing position where the developer layer is disposed opposite to the electrostatic image-bearing surface. Further, when the developer is subjected to such forced movement, the developer layer is further uniformized, whereby a thin and uniform toner layer is formed. Moreover, in such a case, because a broader clearance between the doctor blade 9 and the sleeve 6 may be used, the toner particles are prevented from breakage or agglomeration.

In the developing position, the toner particles are transferred to an electrostatic image formed on the photosensitive drum 22 under the action of an electrostatic force due to the electrostatic image-bearing surface, and under the action of the AC bias or pulse bias.

In the above-mentioned embodiment, an elastic blade comprising an elastic or elastomeric material such as silicone rubber may also be used instead of the doctor blade 9, so that the developer is applied onto the developer-carrying member 6 while the thickness of the developer layer is regulated under pressure.

In the image forming apparatus shown in FIG. 2, the photosensitive layer 5 is charged by means of a primary charger 13 and then exposed by means of a light source (not shown) disposed between the primary charger 13 and the developing device 8, thereby to form thereon an electrostatic image. Because the developer 10 of the present invention has a higher agglomeration degree than an ordinary negatively chargeable developer, the developer 10 contained in the developing device 8 is stirred by means of a stirrer 19 and gradually supplied to the sleeve 6.

The above-mentioned electrostatic image is developed with the one-component developer disposed on the sleeve 6 of the developing device 8, and the resultant toner image formed on the photosensitive layer 5 is transferred to a transfer material 20 such paper conveyed to a transfer position where a transfer charger 15 is disposed opposite to the drum 22, by means of the transfer corona charger 15. The transfer material 20 having thereon the toner image is separated from the electrostatic image-bearing member 22 by means of a separation belt 12, conveyed by a separation roller 21 and a conveyer roller 18, and further conveyed to a fixing position. At the fixing position, the toner image is fixed to the transfer material 20 by means of a heat-and-pressure fixing device comprising a heating roller 16 and a pressure roller 17.

After the above-mentioned transfer of the toner image, the residual toner remaining on the drum 22 is removed by a cleaning blade 23. Thereafter, the above-mentioned image formation process is repeated.

Next, there is specifically described a transfer step constituting the image forming method.

Incidentally, the positively chargeable resin particles used in the present invention are characterized in that they behave along with the toner particles and therefore they regulate the adhesion force between the toner particles and a photosensitive member on the basis of such behavior. Such a method used in the present invention is utterly different from the method disclosed in Japanese Laid-Open Patent Application No. 60470/1981, wherein particles are positively distributed on a non-image portion to reduce the adhesion force between a transfer material and a photosensitive member. According to the above-mentioned method of Japanese Laid-Open Patent Application No. 60470/1981, "paper winding" is improved without decreasing the transfer electric field, but such method has no effect on "afterimage caused by paper" nor has an effect of enhancing the transfer efficiency under a low transfer electric field.

In the transfer step used in the present invention, there may be used an electrostatic transfer method using an electric field generated by a corona charger or a contact roller charger. The transfer condition may be measured in the following manner.

Figure 5:
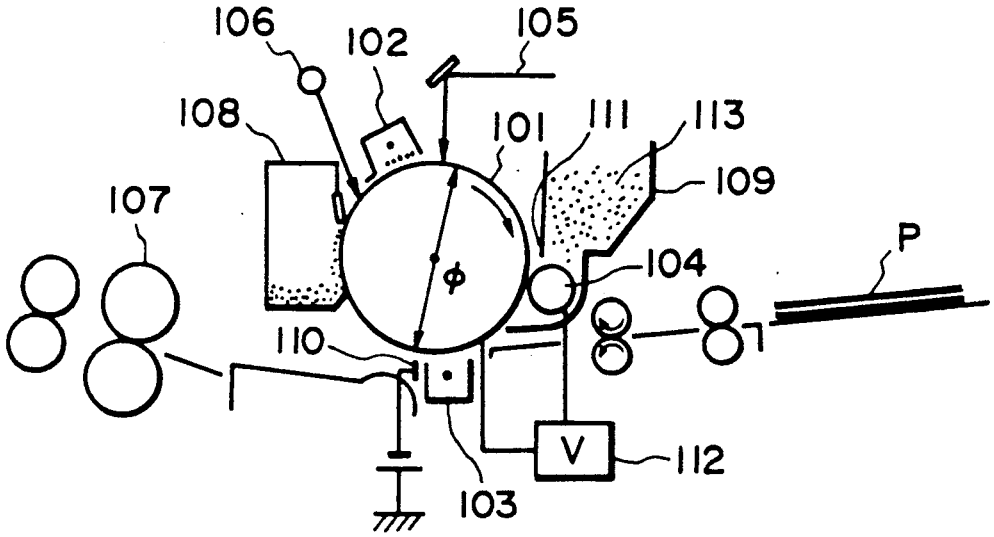
FIG. 5 is a schematic sectional view showing an image forming apparatus used in Example appearing hereinafter.

Referring to FIG. 5, a cleaning device 108, a developing device 109, a transfer charger 103 and the like are removed from an image forming device shown in FIG. 5, a photosensitive member (photosensitive drum) 101 as an electrostatic image-bearing member is charged by means of a primary charger 102. Under a condition under which leakage light is substantially perfectly intercepted, the surface of the photosensitive member 101 corresponding to one rotation thereof is charged and thereafter the surface potential of the photosensitive member 101 is measured by means of a surface electrometer. The surface potential measured at this time is represented by Vpr (V). Then, the photosensitive member surface is wiped with a cloth impregnated with alcohol to discharge (or remove charges from) the photosensitive member 101 surface, the primary charger 102 is removed and the transfer charger 103 is disposed. Thereafter, the surface of the photosensitive member 101 corresponding to one rotation thereof is charged and then the surface potential of the photosensitive member 101 is measured by means of a surface electrometer. The surface potential measured at this time is represented by Vtr (V).

In the transfer step used in the present invention, the ratio of (Vtr/Vpr) may preferably be negative, and the absolute value of Vtr/Vpr (i.e., $|Vtr/Vpr|$) may more preferably be 0.5–1.6, particularly preferably 0.9–1.4. When the above-mentioned absolute value is below 0.5, the transfer electric field is too weak and image deterioration is liable to occur at the time of transfer. When the absolute value exceeds 1.6, the transfer electric field is too strong and the photosensitive member is liable to be charged positively, whereby "afterimage caused by paper" and paper winding are liable to occur.

The present invention may effectively be used in an image forming method or apparatus using a photosensitive member comprising an organic photoconductor (hereinafter, referred to as "OPC photosensitive member"), and may more effectively be used in an image forming method using a reversal development system and a laminate-type OPC photosensitive member which comprises plural layers comprising at least a charge generation layer and a charge transport layer. In the OPC photosensitive member, when the photosensitive layer is charged to have a polarity reverse to that of primary charging, the movement of charges is slow. In the laminate-type OPC photosensitive member, because such a tendency becomes stronger and the above-mentioned afterimage due to paper is liable to occur, the present invention is particularly effective.

In the present invention, the above-mentioned Vpr may preferably be −300 to −1000 (V), more preferably −500 to −900 (V). Below −300 (V), it is difficult to ensure a potential difference suitable for development and the resultant image tends to become unclear. Above −1000 V, dielectric breakdown in the photosensitive layer due to an electric field occurs and image deterioration such as black spots is liable to occur. In view of durability, Vpr may preferably be −500 to −900 (V). On the other hand, it is preferred to regulate Vtr to a voltage of 150 to 1600 V, more preferably 250 to 1400 V.

The image forming method according to the present invention is particularly suitable for an image forming method or apparatus wherein a transfer material such as paper is separated from a photosensitive member by using the elasticity of the transfer material, the curvature of the photosensitive member, or a charge-removing brush, without using mechanical separation means. In the apparatus having no mechanical separation mechanism, because the separation state depends on the transfer condition and paper winding is liable to occur, the present invention is particularly effective.

Figure 6:
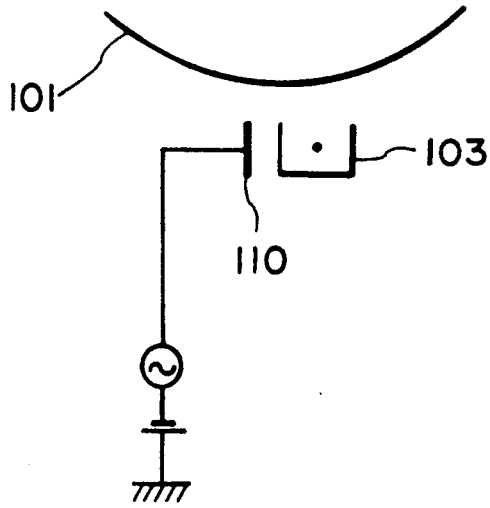
FIG. 6 is an enlarged schematic sectional view showing a transfer position of the above-mentioned apparatus wherein an AC bias and a DC bias are applied to a discharge (or charge-removing) brush.

The present invention is particularly effective with respect to an image forming method (or apparatus) using a photosensitive member 101 having a diameter (i.e., "ϕ" in FIG. 5) of 50 mm or smaller. In the apparatus using a photosensitive drum having a diameter of 50 mm or smaller, because the number of parts are required to be reduced in view of miniaturization, the separation step is generally conducted by using the elasticity of transfer paper and a charge-removing brush 110 as shown in FIG. 6. In such an embodiment, the charge-removing step only discharges the paper, and, in general, the surface potential of the photosensitive member 101 is not affected thereby.

Now, a preferred embodiment of the image forming step according to the present invention is described with reference to FIGS. 5 and 6.

Referring to FIG. 5, the surface of a photosensitive member (drum) 101 is charged negatively by means of a primary charger 102, and then exposure light 105 generated by a light source or laser (not shown) is supplied to the photosensitive member 101 surface according to an image scanning method thereby to form a latent image thereon. The latent image is developed with a one-component magnetic developer 113 to form a toner image in a developing position where a developing sleeve 104 of a developing device 109 is disposed opposite to the photosensitive member 101 surface. The developing device 109 comprises a magnetic blade 111 and the developing sleeve 104 having a magnet (not shown) inside thereof, and contains the developer 113. In the developing position, a bias is applied between the photosensitive drum 101 and the developing sleeve 104 by bias application means 112, as shown in FIG. 5.

As shown in FIG. 5, when a transfer paper P is conveyed to a transfer position where a transfer charger 103 confronts the photosensitive drum 101, the back side surface of the transfer paper P (i.e., the surface thereof opposite to that confronting the photosensitive drum 101) is charged positively by means of the transfer charger 103, whereby the toner image comprising a negatively chargeable toner formed on the photosensitive drum 101 surface is electrostatically transferred to the transfer paper P.

Immediately after the transfer paper P passes through the transfer charger 103, the transfer paper P is separated from the photosensitive drum 101 by curvature separation while removing the charges on the backside surface of the transfer paper P by means of a charge-removing brush. Then, the transfer paper P separated from the photosensitive drum 101 is conveyed to a fixing device 107 using heat and pressure rollers thereby to fix the toner image to the transfer paper P.

The residual one-component developer remaining on the photosensitive drum 101 downstream of the transfer position is removed by a cleaner 108 having a cleaning blade. The photosensitive drum 101 after the cleaning is discharged by erasing exposure 106, and again subjected to the above-mentioned process including the charging step based on the primary charger 2, as the initial step.

The present invention will be explained in further detail by way of Examples. In the following formulations, "part(s)" is part(s) by weight.

EXAMPLE 1

| | |
|---|---|
| Styrene-n-butyl acrylate copolymer (copolymerization wt. ratio = 7:3, weight-average molecular weight (Mw) = 240,000) | 100 parts |
| Magnetic power (magnetite, BET specific surface area: 8.5 $m^2/g$) | 60 parts |
| Low-molecular weight polypropylene (Mw = 6,000) | 4 parts |
| Negative charge control agent (Cr complex of di-tertiary-butyl-salicylic acid) | 2 parts |

The above components were mixed and melt-kneaded by means of a roller mill at 160° C. The kneaded product was cooled and then coarsely crushed by means of a hammer mill and finely pulverized by means of a jet-mill pulverizer. The finely pulverized product was classified by means of a wind-force classifier thereby to prepare a magnetic toner comprising black fine powder.

When the particle size distribution of the magnetic toner was measured by means of a Coulter counter Model TA-II, the toner had a volume-average particle size of 12.5 microns and a number-basis distribution such that it contained 8% by number of particles having a particle size of 4 microns or below. When the triboelectric charge amount of the magnetic toner with respect to iron powder carrier was measured according to the blow-off method, it showed a triboelectric charge amount of $-12$ μc/g.

To 100 parts of the above-mentioned negatively chargeable magnetic toner, 0.4 part of particles of a copolymer predominantly comprising methyl methacrylate units and containing a nitrogen-containing compound (trade name: PTP-2, mfd. by Nihon Paint K.K., average particle size=0.5 microns, triboelectric charge amount=+450 μc/g, longer axis/sorter axis = about 1.0, specific electric resistance = $6.5\times10^{11}$ ohm.cm), and 0.4 part of hydrophobicity-imparted silica fine powder (BET specific surface area = 150 $m^2/g$, average particle size = 10 mμ, triboelectric charge amount = $-180$ μc/g, hydrophobicity based on methanol titration = 50) were added and mixed therewith by means of a Henschel mixer to obtain a one-component type developer.

The thus obtained developer was charged in a page printer as shown in FIG. 2 and evaluated. The results are shown in Table 2 (2A and 2B) appearing hereinafter. In the evaluation, 100 sheets of copies were successively formed by using an original image 1 having a width a of 30 mm and a length of 280 mm as shown in FIG. 1A, and then a copy was formed by using an original image having a width b if 200 mm and a length of 280 mm as shown in FIG. 1B. In the thus obtained image, the image densities of portions 3, **3*a* and 4 as shown in FIG. 1C (1=60 mm) were determined by measuring image densities at five points with respect to the respective portions of 3, 3*a* and 4**, and averaging the resultant five image density values.

In the page printer used herein, a photosensitive drum 22 comprising a negatively chargeable organic photoconductor (OPC) was used, the clearance between a sleeve 6 and a blade 9 was set to 240 microns, the minimum clearance between the sleeve 6 and the photosensitive drum 22 was set to 270 microns, and the thickness of a developer layer formed on the sleeve 6 was 80 microns. Under these conditions, toner image were formed by a reversal development system while applying an AC bias (1,500 Vpp, 1,400 Hz) and a DC bias of −450 V to the sleeve 6.

EXAMPLE 2

| | |
|---|---|
| Styrene-2-ethylhexyl acrylate copolymer (copolymerization wt. ratio = 8:2, Mw = 200,000) | 100 parts |
| Styrene-butadiene copolymer | 10 parts |
| Magnetic power (magnetite, BET specific surface area: 9.0 $m^2/g$) | 70 parts |
| Low-molecular weight polypropylene (Mw = 6,000) | 4 parts |
| Negative charge control agent (Cr complex of monoazo dye) | 1 part |

By using the above components, a magnetic toner was prepared in the same manner as in Example 1.

The thus obtained toner had a volume-average particle size of 11.5 microns and a number-basis distribution such that it contained 7% by number of particles having a particle size of 4 microns or below. The magnetic toner showed a triboelectric charge amount of −14 μc/g.

To 100 parts of the above-mentioned magnetic toner, 0.6 parts of positively chargeable resin particles comprising a dimethylaminoethyl methacrylate polymer (average particle size=0.6 micron, triboelectric charge amount=+300 μc/g, spherical degree (longer axis/shorter axis)=about 1.0, specific electric resistance=$6.5\times10^{10}$ ohm/cm, Mw=60,000), and 0.6 part of hydrophobic silica fine powder obtained by treating dry process silica with hexamethyl-disilazane (BET specific surface area=200 $m^2/g$, average particle size=15 mμ, triboelectric charge amount=−230 μc/g, hydrophobicity based on methanol titration=60) were added to obtain a one-component type magnetic developer.

The thus obtained developer was evaluated in the same manner as in Example 1. The results are shown in Table 2 appearing hereinafter.

EXAMPLE 3

| | |
|---|---|
| Styrene-butyl acrylate copolymer (copolymerization wt. ratio = 8:2, Mw = 270,000) | 100 parts |
| Magnetic power (magnetite, BET specific surface area: 8.0 $m^2/g$) | 50 parts |
| Low-molecular weight polypropylene (Mw = 6,000) | 4 parts |
| Negative charge control agent (Cr complex of monoazo dye) | 2 parts |

By using the above components, a magnetic toner was prepared in the same manner as in Example 1.

The thus obtained toner had a volume-average particle size of 10 microns and a number-basis distribution such that it contained 12% by number of particles having a particle size of 4 microns or below. The magnetic toner showed a triboelectric charge amount of −15 μc/g.

To 100 parts of the above-mentioned magnetic toner, 0.4 part of positively chargeable resin particles used in Example 1 and 0.4 part of hydrophobic silica used in Example 2 were added to obtain a one-component type magnetic developer.

The thus obtained developer was evaluated in the same manner as in Example 1. The results are shown in Table 2 appearing hereinafter.

EXAMPLE 4

A one-component developer was prepared in the same manner as in Example 1 except that the following resin particles were used as positively chargeable resin particles instead of those used in Example 1. When the thus obtained developer was evaluated in the same manner as in Example 1, good results were obtained similarly as in Example 1.

The above-mentioned positively chargeable resin particles were prepared by emulsion-polymerizing methyl methacrylate by use of a nitrogen-containing polymerization initiator without using a surfactant. The thus obtained positively chargeable resin particles had an average particle size of 0.3 micron, a triboelectric charge amount of +450 μc/g, a spherical degree of about 1.0, a specific electric resistance of $3.5\times10^{11}$ ohm.cm and a weight-average molecular weight of 80,000.

EXAMPLES 5-8

One-component developers were prepared in the same manner as in Example 1 except that positively chargeable resin particles as shown in the following Table 1 were used instead of those used in Example 1. When the thus obtained developers were evaluated in the same manner as in Example 1, it was observed that a memory phenomenon in the developer-carrying member was suppressed.

TABLE 1

| Example | Average particle size (μm) | Triboelectric charge amount (μC/g) | Spherical degree | Specific electric resistance (ohm · m) | Mw |
|---|---|---|---|---|---|
| 5 | 0.15 | +200 | 1.0 | $8\times10^{12}$ | 40,000 |
| 6 | 0.90 | +100 | 1.0 | $9\times10^{13}$ | 90,000 |
| 7 | 0.45 | +550 | 1.0 | $5.5\times10^{9}$ | 70,000 |
| 8 | 0.70 | +70 | 1.0 | $3.0\times10^{8}$ | 60,000 |

COMPARATIVE EXAMPLE 1

A one-component developer consisting of the magnetic toner prepared in Example 1 was evaluated in the same manner as in Example 1. The results are shown in Table 2 appearing hereinafter.

COMPARATIVE EXAMPLE 2

A one-component developer was prepared in the same manner as in Example 1 except that the positively chargeable resin particles were not used. The thus obtained developer was evaluated in the same manner as in Example 1. The results are shown in Table 2 appearing hereinafter.

COMPARATIVE EXAMPLE 3

A one-component developer was prepared in the same manner as in Example 1 except that the 0.4 part of negatively chargeable resin particles predominantly comprising styrene units were used instead of the positively chargeable resin particles used in Example 1. The thus obtained developer was evaluated in the same manner as in Example 1. The results are shown in Table 2 appearing hereinafter.

COMPARATIVE EXAMPLE 4

A one-component developer was prepared in the same manner as in Example 1 except that the positively chargeable resin particles having an average particle size of 1.5 micron were used. The thus obtained developer was evaluated in the same manner as in Example 1. The results are shown in Table 2 appearing hereinafter.

COMPARATIVE EXAMPLE 5

A one-component developer was prepared in the same manner as in Example 1 except that the amount of the positively chargeable resin particles used in Example 1 was 4 wt. parts. The thus obtained developer was evaluated in the same manner as in Example 1. The results are shown in Table 2 appearing hereinafter.

TABLE 2A

| | Negatively chargeable magnetic toner (wt. parts) | Resin fine particles (wt. parts/average particle size) (triboelectric charge) | Hydrophobic silica (wt. parts) | Agglomeration degree (%) |
|---|---|---|---|---|
| Example | | | | |
| 1 | 100 | 0.4/0.5 μm (+450 μc/g) | 0.4 | 83 |
| 2 | 100 | 0.6/0.4 μm (+350 μc/g) | 0.6 | 91 |
| 3 | 100 | 0.4/0.8 μm (+180 μc/g) | 0.4 | 78 |
| Comp. Example | | | | |
| 1 | 100 | — | — | 97 |
| 2 | 100 | — | 0.4 | 32 |
| 3 | 100 | 0.4/0.5 μm (−40 μc/g) | 0.4 | 86 |
| 4 | 100 | 0.4/1.5 μm (+200 μc/g) | 0.4 | 51 |
| 5 | 100 | 4.0/0.5 μm (+450 μc/g) | 0.4 | 47 |

TABLE 2B

| | Image density (FIG. 1C) | | | Memory in developer-carrying member (image density difference between region 3a and region 4)*1 |
|---|---|---|---|---|
| | Region 3 | Region 3a | Region 4 | |
| Example | | | | |
| 1 | 1.33 | 1.34 | 1.34 | ○(difference = 0) |
| 2 | 1.27 | 1.28 | 1.27 | ○(difference = 0.01) |
| 3 | 1.38 | 1.36 | 1.35 | ○(difference = 0.01) |
| Comp. Example | | | | |
| 1 | 0.82 | 0.79 | 0.65 | Δ (difference = 0.14) |
| 2 | 1.36 | 1.35 | 1.01 | x (difference = 0.34) |
| 3 | 0.92 | 0.95 | 0.74 | Δ (difference = 0.21) |
| 4 | 1.25 | 1.22 | 1.10 | Δ (difference = 0.12)*2 |
| 5 | 1.04 | 1.02 | 0.86 | Δ (difference = 0.16) |

*1: The symbols have the following meanings:
○: The above-mentioned image density difference was below 0.1.
Δ: The image density difference was 0.1 to 0.2.
x: The image density difference exceeded 0.2.
*2: Black spots occurred.

With respect to developer-carrying members used in the above Examples 1-3 and Comparative Examples 1-4, the toner particles constituting the toner layer disposed on each developer-carrying member were collected by means of a transparent adhesive tape for 3 to 4 times and the toner particles constituting the lowest portion of the toner layer disposed on the developer-carrying member were observed by means of an optical microscope.

As a result, in the developer-carrying members used in Examples 1-3, substantially no difference was observed with respect to the particle sizes of the toner particles collected to the adhesive tapes. On the other hand, in the developer-carrying members used in Comparative Examples 1, 3 and 4, it was observed that a large amount of fine toner particles (having a particle size of about 4 microns or smaller) were present on the adhesive tape by which the lowest toner layer had been collected. In the developer-carrying member used in Comparative Example 2, it was observed that a larger amount of fine particles were present on the adhesive tape.

From the above-mentioned results, it was confirmed that the presence of fine particles of 4 microns or smaller in the lowest toner layer disposed on a developer-carrying member closely affects a memory phenomenon in the developer-carrying member.

Therefore, when the developer according to the present invention is used, there are advantageously obtained various effects such that the memory phenomenon in a developer-carrying member is prevented; and stable copied images which have a high image density and are free of black spots or fog are provided.

EXAMPLE 9

| | |
|---|---|
| Styrene-n-butyl acrylate copolymer (copolymerization wt. ratio = 7:3, weight-average molecular weight (Mw) = 240,000) | 100 parts |
| Magnetic power (magnetite, BET specific surface area: 8.5 $m^2/g$) | 60 parts |
| Low-molecular weight polypropylene (Mw = 6,000) | 3 parts |
| Negative charge control agent (Cr complex of di-tertiary-butyl-salicylic acid) | 2 parts |

The above components were melt-kneaded, pulverized and classified to obtain a negatively chargeable one-component magnetic toner having an average particle size of 12 microns.

To 100 parts of the thus obtained toner, 0.5 part of positively chargeable spherical resin particles (specific electric resistance $=6.5\times10^{11}$ ohm.cm, spherical degree=about 1.0) and 0.4 part of hydrophobic colloidal silica (triboelectric charge amount $=-180$ μc/g) were added and mixed therewith to obtain a developer for visualizing a latent image The thus obtained developer was charged in a commercially available laser beam printer (trade name: LBP-CX, mfd. by Canon K.K.) and subjected to a successive printout test of 4,000 sheets under normal temperature-normal humidity conditions (20° C., 60% RH), high temperature-high humidity conditions (35° C., 85% RH), and low temperature-low humidity conditions (15° C., 10% RH).

As a result, under each set of conditions, high-density images free of an image defect such as ghost and fog in the form of black spots were provided. The image quality at the time of 4,000 sheets was good and substantially the same as that in the initial stage.

EXAMPLE 10

A developer containing a toner for visualization was prepared in the same manner as in Example 9 except that 0.5 part of positively chargeable spherical resin particles (specific electric resistance $=3.0\times10^{14}$ ohm.cm, spherical degree = about 1.01) were used instead of those used in Example 9.

The thus obtained developer was subjected to the same test as in Example 9.

As a result, under each set of conditions, high-density images free of an image defect such as ghost and fog in the form of black spots were provided. The image quality at the time of 4,000 sheets was good and substantially the same as that in the initial stage.

EXAMPLE 11

A developer containing a toner for visualization was prepared in the same manner as in Example 9 except that 0.5 part of positively chargeable spherical resin particles (specific electric resistance $=2.5\times10^{9}$ ohm.cm) were used instead of those used in Example 9.

The thus obtained developer was subjected to the same test as in Example 9.

As a result, under each set of conditions, high-density images free of an image defect such as ghost and fog in the form of black spots were provided The image quality at the time of 4,000 sheets was good and substantially the same as that in the initial stage.

TABLE 3

| | Resin particle | | | Memory | |
|---|---|---|---|---|---|
| Example | Specific electric resistance (ohm · cm) | Charge amount (μc/g) | Image reflection density | phenomenon in developer-carrying member | Black spot fog |
| 9 | $6.5\times10^{11}$ | +498 | 1.35 | o | o |
| 10 | $3.0\times10^{14}$ | +454 | 1.31 | o | o |
| 11 | $2.5\times10^{9}$ | +446 | 1.28 | o | o |

As described above, the electrophotographic dry developer according to the present invention prevents the adhesion of toner particles onto a sleeve and is capable of forming a layer of toner particles uniformly charged on the sleeve, whereby various problems encountered in the conventional magnetic one-component developer are solved. The developer according to the present invention exhibits a good developing characteristic and provides a stable image free of ghost not only under normal temperature-normal humidity conditions but also under high temperature-high humidity and low temperature-low humidity conditions. Further, the developer of the present invention is excellent in durability and provides stable image quality for a long period.

EXAMPLE 12

| | |
|---|---|
| Styrene-butyl acrylate copolymer (copolymerization weight ratio = 8:2) | 100 wt. parts |
| Magnetic material (magnetite) | 60 wt. parts |
| Release agent (polypropylene wax) | 3 wt. parts |
| Charge controller (chromium complex of monoazo dye) | 2 wt. parts |

The above components were melt-kneaded by means of a two-axis extruder heated up to 160° C., and the kneaded product, after cooling, was coarsely crushed by means of a hammer mill (mechanical pulverizer) to about 2 mm-mesh pass, and then finely pulverized by means of a jet mill (wind-force pulverizer) to about 10 microns. The finely pulverized product was classified by means of DS Classifier (a wind-force classifier) so that the volume-average particle size measured by a Counter counter became 11.5 microns, thereby to obtain a negatively chargeable insulating magnetic toner. The thus obtained insulating magnetic toner showed a triboelectric charge of −13 μc/g according to the blow-off method, when mixed with iron powder carrier.

To 100 wt. parts of the negatively chargeable magnetic toner, 0.4 wt. part of spherical positively chargeable resin particles comprising copolymer predominantly comprising structural units originating from a methyl methacrylate monomer and containing a nitrogen-containing compound (trade name: PTP-2, mfd. by Nihon Paint K.K., average particle size=0.5 micron, triboelectric charge amount=+450 μc/g, spherical degree = about 1.0, specific electric resistance $=6.5\times10^{11}$ ohm.cm), and 0.4 part of hydrophobic silica fine powder (triboelectric charge amount=−190 μc/g, hydrophobicity based on transmittance (as described hereinafter)=95%, hydrophobicity based on methanol titration=65) which had been obtained by treating dry process silica having a BET specific surface area of 130 $m^2/g$ with hexamethyldisilazane and then treating the resultant product with dimethylsilicone were added and mixed therewith by means of a Henschel mixer to obtain a one-component type developer.

The thus obtained developer was charged in a copying machine as shown in FIG. 5. The copying machine used herein was obtained by modifying a commercially available copying machine (trade name: FC-5, mfd. by Canon K.K.) so as to effect reversal development. The above-mentioned "FC-5" was a copying machine wherein a 30 mm-dia. negatively chargeable photosensitive drum of an OPC laminate-type and a charge-removing needle imparted with a bias of −1.0 KV were used, and a transfer material was separated from the photosensitive member by curvature separation.

The image formation was effected under conditions under which Vpr=−700 V, $|Vtr/Vpr|=1.0$ (Vtr=+700 V), the clearance between the photosensitive drum and a developing drum (containing a magnet therein) was so set that the developer layer formed on the developing drum did not contact the photosensitive drum, and an AC bias (1800 KHz, Vpp=1,600 V) and a DC bias ($V_{DC}=-500$ V) were applied to the developing drum.

The thus formed toner image was fixed by heat-and-pressure roller fixing and evaluated in the following manner. The results are shown in Table 4 (i.e., Tables 4A and 4B) appearing hereinafter.

(1) Image density 1,000 sheets of ordinary plain paper for copying machine (75 $g/m^2$) were passed through the copying machine, and the image density at the time of 1,000 sheets of copying was evaluated.

o (good): Image density of 1.35 or above
Δ (rather good): Image density of 1.0–1.34
x (not good): Image density of below 1.0

(2) Transfer state

Thick paper (120 $g/m^2$) providing severer transfer conditions was passed through the copying machine and it was observed whether transfer defect (partially white image) occurred.

○: good
Δ: usable in practice
x: unusable in practice (3) Paper winding 1,000 sheets of thin paper (50 g/m$^2$) were passed through the copying machine and the occurrence of paper jam was evaluated.

○: once or less per 1,000 sheets
Δ: 2–4 times per 1,000 sheets
x: 5 times or more per 1,000 sheets (4) Afterimage caused by paper Completely solid image was output, and the uniformity therein was evaluated in terms of the difference in image density between the maximum and minimum image densities.

○: image density difference of 0.05 or smaller
Δ: image density difference of 0.06–0.15
x: image density difference of 0.16 or larger (5) Image quality Toner scattering and coarsening were observed with naked eyes.

○: good
Δ: usable in practice
x: unusable in practice

In the above Example 12, the hydrophobicity of the silica fine powder was measured in the following manner.

100 g of pure water and 1 g of a sample was charged in a container equipped with a sealing stopper and shaken for 10 min. by means of a shaker. After the shaking, the resultant mixture was left standing, e.g., for several minutes. After the silica powder layer was separated from the aqueous layer, the aqueous layer was sampled and the transmittance thereof was measured at a wavelength of 500 nm while using blank pure water containing no silica fine powder as a reference. The thus obtained value of the transmittance was used as the above-mentioned hydrophobicity of treated silica fine powder.

According to such measurement method, the silica fine powder used in the present invention may preferably have a hydrophobicity of 90% or larger, more preferably 93% or larger. When the hydrophobicity is below 90%, a high-quality image is less liable to be provided because the silica fine powder adsorbs water under a high humidity condition.

EXAMPLE 13

Image formation was effected in the same manner as in Example 12 except that the ratio of Vtr/Vpr was −0.5. The results are shown in Table 4 appearing hereinafter.

EXAMPLE 14

Image formation was effected in the same manner as in Example 12 except that the ratio of Vtr/Vpr was −1.6. The results are shown in Table 4 appearing hereinafter.

EXAMPLE 15

Image formation was effected in the same manner as in Example 12 except that the ratio of Vtr/Vpr was −2.0. The results are shown in Table 4 appearing hereinafter.

EXAMPLE 16

A developer was prepared in the same manner as in Example 12 except that positively chargeable spherical resin particles having an average particle size of 0.1 micron and capable of providing a triboelectric charge amount of +450 μc/g were used instead of those used in Example 12.

By using the thus obtained developer, image formation was effected in the same manner as in Example 12. The results are shown in Table 4 appearing hereinafter.

EXAMPLE 17

A developer was prepared in the same manner as in Example 12 except that positively chargeable spherical resin particles having an average particle size of 1.0 micron and capable of providing a triboelectric charge amount of +380 μc/g were used instead of those used in Example 12.

By using the thus obtained developer, image formation was effected in the same manner as in Example 12. The results are shown in Table 4 appearing hereinafter.

EXAMPLE 18

A developer was prepared in the same manner as in Example 12 except that positively chargeable spherical resin particles having an average particle size of 0.4 micron and capable of providing a triboelectric charge amount of +50 μc/g were used instead of those used in Example 12.

By using the thus obtained developer, image formation was effected in the same manner as in Example 12. The results are shown in Table 4 appearing hereinafter.

EXAMPLE 19

A developer was prepared in the same manner as in Example 12 except that positively chargeable spherical resin particles having an average particle size of 0.4 micron and capable of providing a triboelectric charge amount of +600 μc/g were used instead of those used in Example 12.

By using the thus obtained developer, image formation was effected in the same manner as in Example 2. The results are shown in Table 4 appearing hereinafter.

EXAMPLE 20

A developer was prepared in the same manner as in Example 12 except that 0.1 wt. part of positively chargeable spherical resin particles having an average particle size of 0.4 micron and capable of providing a triboelectric charge amount of +400 μc/g were used instead of those used in Example 12.

By using the thus obtained developer, image formation was effected in the same manner as in Example 12. The results are shown in Table 4 appearing hereinafter.

EXAMPLE 21

A developer was prepared in the same manner as in Example 12 except that 2.0 wt. parts of the positively chargeable resin particles were added.

By using the thus obtained developer, image formation was effected in the same manner as in Example 12. The results are shown in Table 4 appearing hereinafter.

COMPARATIVE EXAMPLE 6

A developer was prepared in the same manner as in Example 12 except that positively chargeable resin particles were not added.

By using the thus obtained developer, image formation was effected in the same manner as in Example 12. The results are shown in Table 4 appearing hereinafter.

COMPARATIVE EXAMPLE 7

A developer was prepared in the same manner as in Example 12 except that 0.4 wt. part of positively chargeable spherical resin particles having an average particle size of 0.05 micron and capable of providing a triboelectric charge amount of +800 μc/g were used instead of those used in Example 12.

By using the thus obtained developer, image formation was effected in the same manner as in Example 12. The results are shown in Table 4 appearing hereinafter.

COMPARATIVE EXAMPLE 8

A developer was prepared in the same manner as in Example 12 except that 0.4 wt. part of positively chargeable spherical resin particles having an average particle size of 1.5 micron and capable of providing a triboelectric charge amount of +30 μc/g were used instead of those used in Example 12.

By using the thus obtained developer, image formation was effected in the same manner as in Example 12. The results are shown in Table 4 appearing hereinafter.

TABLE 4A

| | Transfer condition Vtr/Tpr | Resin particle condition: Particle size (μ) | Charge amount (μc/g) | Addition amount (wt. parts) |
|---|---|---|---|---|
| Example | | | | |
| 12 | −1.0 | 0.4 | 400 | 0.4 |
| 13 | −0.5 | 0.4 | 400 | 0.4 |
| 14 | −1.6 | 0.4 | 400 | 0.4 |
| 15 | −2.0 | 0.4 | 400 | 0.4 |
| 16 | −1.0 | 0.1 | 450 | 0.4 |
| 17 | −1.0 | 1.0 | 380 | 0.4 |
| 18 | −1.0 | 0.4 | 50 | 0.4 |
| 19 | −1.0 | 0.4 | 600 | 0.4 |
| 20 | −1.0 | 0.4 | 400 | 0.1 |
| 21 | −1.0 | 0.4 | 400 | 2.0 |
| Comp. Example | | | | |
| 6 | −1.0 | — | — | — |
| 7 | −1.0 | 0.05 | 800 | 0.4 |
| 8 | −1.0 | 1.5 | 30 | 0.4 |

TABLE 4B

| | Evaluation: Image density | Transfer | Paper winding | Afterimage caused by paper | Image quality |
|---|---|---|---|---|---|
| Example | | | | | |
| 12 | ○ | ○ | ○ | ○ | ○ |
| 13 | ○ | Δ | ○ | ○ | Δ |
| 14 | ○ | ○ | ○ | Δ | ○ |
| 15 | ○ | ○ | Δ | Δ | Δ |
| 16 | ○ | Δ | ○ | ○ | ○ |
| 17 | Δ | ○ | ○ | ○ | ○ |
| 18 | ○ | Δ | ○ | ○ | Δ |
| 19 | Δ | ○ | ○ | ○ | Δ |
| 20 | ○ | Δ | ○ | ○ | ○ |
| 21 | Δ | ○ | ○ | ○ | Δ |
| Comp. Example | | | | | |

TABLE 4B-continued

| | Evaluation: Image density | Transfer | Paper winding | Afterimage caused by paper | Image quality |
|---|---|---|---|---|---|
| 6 | ○ | x | ○ | ○ | ○ |
| 7 | ○ | x | ○ | ○ | x |
| 8 | x | x | ○ | ○ | x |

EXAMPLE 22

| | |
|---|---|
| Styrene-butyl acrylate copolymer | 100 wt. parts |
| Magnetite | 60 wt. parts |
| Release agent (Low-molecular weight polypropylene) | 4 wt. parts |
| Negative type charge controller (chromium complex of monoazo dye) | 2 wt. parts |

The above components were melt-kneaded, pulverized and classified to obtain a negatively chargeable one-component magnetic toner having a volume-average particle size of 12 microns and showing a triboelectric charge of −10 μc/g.

To 100 wt. parts of the maghetic toner, 0.5 wt. part of spherical positively chargeable resin particles predominantly comprising PMMA (particle size=0.4 micron, triboelectric charge amount=+450 μc/g, specific resistance=$10^9$ ohm.cm), and 0.4 part of hydrophobic silica treated with a silicone oil (triboelectric charge amount=−200 μc/g, hydrophobicity based on methanol titration=60) were added and mixed therewith by means of a Henschel mixer to obtain a negatively chargeable one-component type magnetic developer.

The thus obtained developer was charged in a laser beam printer (trade name: LBP-SX, mfd. by Canon K.K.) using a reversal development system wherein the ratio of Vtr/Vpr was regulated to −1.0, and subjected to a successive printout test of 4,000 sheets under normal temperature-normal humidity conditions (23° C., 65% RH). The results are shown in Table 5 appearing hereinafter.

EXAMPLE 23

A developer was prepared in the same manner as in Example 22 except that resin particles providing a charge amount of +300 μc/g were used instead of those used in Example 22.

The thus obtained developer was subjected to a successive printout test in the same manner as in Example 22. The results are shown in Table 5 appearing hereinafter.

EXAMPLE 24

A developer was prepared in the same manner as in Example 22 except that resin particles providing a charge amount of +100 μc/g were used instead of those used in Example 22.

The thus obtained developer was subjected to a successive printout test in the same manner as in Example 22. The results are shown in Table 5 appearing hereinafter.

TABLE 5

| | Start | | 2,000 sheets | | 4,000 sheets | |
|---|---|---|---|---|---|---|
| Example | Dmax | Partially white image* | Dmax | Partially white image* | Dmax | Partial white image* |
| 22 | 1.31 | ◎ | 1.36 | ◎ | 1.38 | ○ |
| 23 | 1.30 | ◎ | 1.36 | ○ | 1.38 | ○ |
| 24 | 1.27 | ◎ | 1.32 | ○ | 1.35 | ○ |

*Partially white image was evaluated with respect to hollow characters formed on thick paper (a postcard).

EXAMPLE 25

A developer was prepared in the same manner as in Example 12 except that 0.5 part of silica fine powder treated with an olefin-modified silicone oil (hydrophobicity: 99%, triboelectric charge amount: −150 μc/g) was added instead of the silica fine powder used in Example 12.

When the thus obtained developer was subjected to the same image formation test as in Example 12, good results were obtained.

What is claimed is:

1. A developer for developing electrostatic images, comprising, at least, 100 wt. parts of a negatively chargeable magnetic toner having a volume-average particle size of 5 to 30 microns;

0.1 to 3 wt. parts of positively chargeable resin particles having an average particle size of 0.1 to 1.0 micron; and 0.05 to 3 wt. parts of hydrophobic silica fine powder having a triboelectric chargeability of −100 to −300 μc/g.

2. A developer according to claim 1, wherein the positively chargeable resin particles have a triboelectric chargeability of +50 μc/g to +600 μc/g.

3. A developer according to claim 1, wherein the positively chargeable resin particles have a triboelectric chargeability of +100 μc/g to +600 μc/g.

4. A developer according to claim 1, wherein the positively chargeable resin particles have an average particle size of 0.2 to 1.0 micron.

5. A developer according to claim 1, wherein the positively chargeable resin particles have a ratio of longer axis to shorter axis of 1.0 to 1.02.

6. A developer according to claim 5, wherein the positively chargeable resin particles have a spherical or spheroidal shape.

7. A developer according to claim 1, wherein the positively chargeable resin particles have a triboelectric chargeability of +50 μc/g to +600 μc/g and an average particle size of 0.2 to 1.0 micron and a spherical or spheroidal shape having a ratio of longer axis to shorter axis of 1.0 to 1.02.

8. A developer according to claim 7, wherein the positively chargeable resin particles have a triboelectric chargeability +100 μc/g to +600 μc/g.

9. A developer according to claim 1, wherein the positively chargeable resin particles comprise a resin having a weight-average molecular weight of 100,000 to 200,000.

10. A developer according to claim 1, wherein the positively chargeable resin particles comprise a resin obtained by polymerizing a vinyl monomer or a mixture thereof selected from the group consisting of methyl methacrylate, dimethylaminoethyl methacrylate, diethylaminoethyl methacrylate, N-methyl-N-phenylaminoethyl methacrylate, diethylaminoethyl methacrylamide, dimethylaminoethyl methacrylamide, 4-vinylpyridine and 2-vinylpyridine.

11. A developer according to claim 7, wherein the positively chargeable resin particles comprise a resin having a weight-average molecular weight of 100,000 to 200,000.

12. A developer according to claim 11, wherein the positively chargeable resin particles comprise a resin obtained by polymerizing a vinyl monomer or a mixture thereof selected from the group consisting of methyl methacrylate, dimethylaminoethyl methacrylate, diethylaminoethyl methacrylate, N-methyl-N-phenylaminoethyl methacrylate, diethylaminoethyl methacrylamide, dimethylaminoethyl methacrylamide, 4-vinylpyridine and 2-vinylpyridine.

13. A developer according to claim 1, wherein the positively chargeable resin particles have a specific electric resistance of $10^8$ to $10^{14}$ ohm/cm.

14. A developer according to claim 1, wherein the negatively chargeable magnetic toner comprise at least a binder resin comprising a vinyl-type polymer or copolymer and a magnetic material.

15. A developer according to claim 14, wherein the negatively chargeable magnetic toner contains a binder resin selected from the group consisting of styrene-n-butyl acrylate, styrene-n-butyl methacrylate, and styrene-n-butyl acrylate-2-ethylhexyl methacrylate.

16. A developer according to claim 14, wherein the negatively chargeable magnetic toner contains a binder resin of which tetrahydrofuran-soluble has a weight-average molecular weight of 100,000 to 200,000.

17. A developer according to claim 1, wherein the negatively chargeable magnetic toner contains a magnetic material having a BET specific surface areas of 2 to 20 $m^2/g$.

18. A developer according to claim 1, wherein the negatively chargeable magnetic toner contains a magnetic material having a BET specific surface area of 2.5 to 12 $m^2/g$.

19. A developer according to claim 1, wherein the negatively chargeable magnetic toner contains a magnetic material having a Mohs' hardness of 5–7.

20. A developer according to claim 1, wherein the negatively chargeable toner contains 10 to 70wt.% of a magnetic material based on the weight of the toner.

21. A developer according to claim 1, wherein the negatively chargeable magnetic toner has a volume resistivity of $10^{10}$ ohm.cm or larger.

22. A developer according to claim 1, wherein the negatively chargeable magnetic toner has a volume resistivity of $10^{12}$ ohm/cm or larger.

23. A developer according to claim 1, wherein the negatively chargeable magnetic toner has a triboelectric chargeability of −8 μc/g to −40 μc/g.

24. A developer according to claim 1, wherein the negatively chargeable magnetic toner has a triboelectric chargeability of −8 μc/g to −20 μc/g.

25. A developer according to claim 1, wherein the negatively chargeable magnetic toner has a volume-average particle size of 5 to 30 microns.

26. A developer according to claim 11, wherein the negatively chargeable magnetic toner has a volume-average particle size of 6 to 15 microns.

27. A developer according to claim 1, wherein the negatively chargeable magnetic toner has a volume-average particle size of 7 to 15 microns.

28. A developer according to claim 1, wherein the hydrophobic silica fine powder has a BET specific surface area of 70–300 $m^2/g$.

29. A developer according to claim 1, wherein the hydrophobic silica fine powder has an average particle size of 5 to 30 microns.

30. A developer according to claim 1, wherein the hydrophobic silica fine powder has a hydrophobicity of 30 to 80 according to a methanol titration test.

31. A developer according to claim 1, wherein he hydrophobic silica fine powder has been mixed with 100 wt. parts of the negatively chargeable magnetic toner in an amount of 0.1 to 2 wt. parts.

32. A developer according to claim 1, wherein the addition amount of the hydrophobic silica fine powder to that of the positively chargeable resin particles is 1:0.1 to 1:60.

33. A developer according to claim 1, wherein the addition amount of the hydrophobic silica fine powder to that of the positively chargeable resin particles is 1:0.1 to 1:10.

34. A developer according to claim 1, wherein the negatively chargeable magnetic toner has a volume-average particle size of 5–30 microns, a triboelectric chargeability of $-8$ $\mu c/g$ to $-20$ $\mu c/g$ and a volume resistivity of $10^{12}$ or larger, and comprises a binder resin comprising a vinyl-type polymer or copolymer, 10 to 70 wt.% of a magnetic material and a negative charge control agent;

the positively chargeable resin particles have a triboelectric chargeability of $+100$ $\mu c/g$ to $+600$ $\mu c/g$, an average particle size of 0.2 to 1.0 micron, a spherical or spheroidal shape having a ratio of longer axis to shorter axis of 1.0 to 1.02, and a specific electric resistance of $10^8$–$10^{14}$ ohm.cm, and comprise a vinyl-type resin having a weight-average molecular weight of 100,000 to 200,000; and the hydrophobic silica fine powder has a BET specific surface area of 70 to 300 $m^2/g$ and a hydrophobicity of 30 to 80 based on a methanol titration test.

35. A developer according to claim 34, wherein the ratio of the addition amount of the hydrophobic silica fine powder to that of the positively chargeable resin particles is 1:01.1 to 1:60.

36. A developer according to claim 34, which has an agglomeration degree of 70–95%.

* * * * *

UNITED STATES PATENT AND TRADEMARK OFFICE

CERTIFICATE OF CORRECTION

PATENT NO. : 5,041,351

DATED : August 20, 1991

INVENTOR(S) : NAOTO KITAMORI, ET AL.

It is certified that error appears in the above-identified patent and that said Letters Patent is hereby corrected as shown below:

COLUMN 1

Line 28, "No. 2,297,691" should read --No. 2,297,691,--.
Line 31, "No. 4,071,361," should read --No. 4,071,361),--.
Line 68, "size;" should read --size:--.

COLUMN 2

Line 18, "layer," should read --layer--.
Line 49, "is" should read --are--.

COLUMN 3

Line 18, "NO." should read --No.--.
Line 24, "show" should read --showed--.

COLUMN 4

Line 35, "as" should read --has--.
Line 64, "4353648)" should read --4,353,648)--.

COLUMN 5

Line 14, "a" should read --the--.
Line 62, "particle" should read --particles--.

COLUMN 6

Line 20, "and" should read --and which--.

UNITED STATES PATENT AND TRADEMARK OFFICE

CERTIFICATE OF CORRECTION

PATENT NO. : 5,041,351

DATED : August 20, 1991

INVENTOR(S) : NAOTO KITAMORI, ET AL.

It is certified that error appears in the above-identified patent and that said Letters Patent is hereby corrected as shown below:

COLUMN 7

Line 63, "Example" should read --Example 12--.

COLUMN 8

Line 25, "particle" should read --particles--.
Line 47, "microns," should read --micron,-- and
"microns." should read --micron.--.
Line 49, "microns" should read --micron--.
Line 51, "particle" should read --particle size--.
Line 65, "image," should read --image--.

COLUMN 9

Line 41, "remain" should read --remains--.
Line 43, "a" should be deleted.
Line 57, "can" should read --it can--.

COLUMN 10

Line 5, "numeral 48" should read --numeral 47--.
Line 8, "and" should read --,--.

COLUMN 11

Line 33, "ohm/cm" should read --ohm.cm--.
Line 34, "ohm/cm" should read --ohm.cm--.
Line 35, "ohm/cm" should read --ohm.cm--.
Line 66, "in hands" should read --by hand--.

--

UNITED STATES PATENT AND TRADEMARK OFFICE

CERTIFICATE OF CORRECTION

PATENT NO. : 5,041,351

DATED : August 20, 1991

INVENTOR(S) : NAOTO KITAMORI, ET AL.

It is certified that error appears in the above-identified patent and that said Letters Patent is hereby corrected as shown below:

COLUMN 12

Line 34, "100" should read --100-micron--.
Line 35, "micron-aperture" should read --aperture--.
Line 61, "a" should be deleted.

COLUMN 13

Line 2, "in" should read --by hand--.
Line 3, "hands" should be deleted.
Line 4, "shaked" should read --shaken--.

COLUMN 14

Line 30, "parts" should read --part--.
Line 38, "a" (first occurrence) should be deleted.

COLUMN 15

Line 9, "not" should read --not to be--.
Line 33, "such" should read --such as--.

COLUMN 16

Line 19, "member 22." should read --drum 22.--.

COLUMN 17

Line 32, "such" should read --such as--.

--

UNITED STATES PATENT AND TRADEMARK OFFICE

CERTIFICATE OF CORRECTION

PATENT NO. : 5,041,351

DATED : August 20, 1991

INVENTOR(S) : NAOTO KITAMORI, ET AL.

It is certified that error appears in the above-identified patent and that said Letters Patent is hereby corrected as shown below:

COLUMN 18

Line 9, "5," should read --5, and--.

COLUMN 20

Line 2, "charger 2," should read --charger 102,--.
Line 13, "(Mw) = 240,000)" should read --(Mw = 240,000)--.
Line 14, "power" should read --powder--.
Line 45, "microns," should read --micron,--.
Line 46, "axis/sorter" should read --axis/shorter--.
Line 57, "Table 2 (2A and 2B)" should read --Tables 2A and 2B--.
Line 62, "if" should read --of--.

COLUMN 21

Line 8, "image" should read --images--.
Line 19, "power" should read --powder--.
Line 35, "parts" should read --part--.
Line 40, "ohm/cm," should read --ohm.cm--.
Line 49, "Table 2" should read --Tables 2A and 2B--.
Line 56, "power" should read --powder--.

COLUMN 22

Line 10, "Table 2" should read --Tables 2A and 2B--.
TABLE 1, "(μC/g)" should read --(μc/g)-- and "(ohm.m)" should read --(ohm.cm)--.
Line 55, "Table 2" should read --Tables 2A and 2B--.
Line 62, "Table 2" should read --Tables 2A and 2B--.

--

UNITED STATES PATENT AND TRADEMARK OFFICE

CERTIFICATE OF CORRECTION

PATENT NO. : 5,041,351

DATED : August 20, 1991

INVENTOR(S) : NAOTO KITAMORI, ET AL.

It is certified that error appears in the above-identified patent and that said Letters Patent is hereby corrected as shown below:

COLUMN 23

Line 4, "Table 2" should read --Tables 2A and 2B--.
Line 11, "micron" should read --microns--.
Line 13, "Table 2" should read --Tables 2A and 2B--.
Line 20, "Table 2" should read --Tables 2A and 2B--.
TABLE 2B, " Δ(difference = 0.21)" should read
-- x(difference = 0.21)--.

COLUMN 24

Line 8, "to" should read --on--.
Line 36, "(Mw) = 240,000" should read --(Mw = 240,000)--.
Line 37, "power" should read --powder--.

COLUMN 25

Line 26, "provided" should read --provided.--.

COLUMN 26

Line 4, "Counter" should read --Coulter--.
Line 54, "Table 4 (i.e.," should be deleted.
Line 55, "4B)" should read --4B--.

COLUMN 27

Line 22, Close up left margin.
Line 33, "was" should read --were--.
Line 57, "Table 4" should read --Tables 4A and 4B--.
Line 63, "Table 4" should read --Tables 4A and 4B--.

UNITED STATES PATENT AND TRADEMARK OFFICE

CERTIFICATE OF CORRECTION

PATENT NO. : 5,041,351

DATED : August 20, 1991

INVENTOR(S) : NAOTO KITAMORI, ET AL.

It is certified that error appears in the above-identified patent and that said Letters Patent is hereby corrected as shown below:

COLUMN 28

Line 1, "Table 4" should read --Tables 4A and 4B--.
Line 14, "Table 4" should read --Tables 4A and 4B--.
Line 25, "Table 4" should read --Tables 4A and 4B--.
Line 36, "Table 4" should read --Tables 4A and 4B--.
Line 47, "Example 2" should read --Example 12--.
Line 48, "Table 4" should read --Tables 4A and 4B--.
Line 59, "Table 4" should read --Tables 4A and 4B--.
Line 68, "Table 4" should read --Tables 4A and 4B--.

COLUMN 29

Line 8, "Table 4" should read --Tables 4A and 4B--.
Line 19, "Table 4" should read --Tables 4A and 4B--.
Line 25, "micron" should read --microns--.
Line 30, "Table 4" should read --Tables 4A and 4B--.
TABLE 4A, "Vtr/Tpr" should read --Vtr/Vpr--.

COLUMN 31

TABLE 5, After "(a postcard).", insert:
--○: good
◎: very good--.

COLUMN 32

Line 21, "comprise" should read --comprises--.
Line 35, "areas" should read --area--.
Line 45, "70wt.%" should read --70 wt. %--.
Line 52, "$10^{12}$ohm/cm" should read --$10^{12}$ohm.cm--.

--

UNITED STATES PATENT AND TRADEMARK OFFICE

CERTIFICATE OF CORRECTION

PATENT NO. : 5,041,351

DATED : August 20, 1991

INVENTOR(S) : NAOTO KITAMORI, ET AL.

It is certified that error appears in the above-identified patent and that said Letters Patent is hereby corrected as shown below:

COLUMN 33

Line 10, "he" should read --the--.

Signed and Sealed this

Ninth Day of August, 199

Attest:

Bruce Lehman

BRUCE LEHMAN

Attesting Officer

Commissioner of Patents and Trademarks